US010774702B2

(12) United States Patent
Honda et al.

(10) Patent No.: US 10,774,702 B2
(45) Date of Patent: Sep. 15, 2020

(54) OIL SUPPLY DEVICE OF ENGINE, METHOD OF MANUFACTURING ENGINE, AND OIL SUPPLY PASSAGE STRUCTURE OF ENGINE

(71) Applicant: MAZDA MOTOR CORPORATION, Aki-gun, Hiroshima (JP)

(72) Inventors: Kenta Honda, Hiroshima (JP); Tomohiro Koguchi, Higashihiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 551 days.

(21) Appl. No.: 15/550,735

(22) PCT Filed: Mar. 1, 2016

(86) PCT No.: PCT/JP2016/001083
§ 371 (c)(1),
(2) Date: Aug. 11, 2017

(87) PCT Pub. No.: WO2016/139923
PCT Pub. Date: Sep. 9, 2016

(65) Prior Publication Data

US 2018/0030867 A1 Feb. 1, 2018

(30) Foreign Application Priority Data

Mar. 5, 2015 (JP) ..... 2015-044008

(51) Int. Cl.
*F01M 5/00* (2006.01)
*F01M 11/02* (2006.01)
(Continued)

(52) U.S. Cl.
CPC ..... *F01M 11/02* (2013.01); *F01M 1/02* (2013.01); *F01M 1/06* (2013.01); *F01M 1/08* (2013.01);
(Continued)

(58) Field of Classification Search
CPC ..... F01M 11/0004; F01M 11/02; F01M 1/02; F01M 11/03; F01M 2011/0066;
(Continued)

(56) References Cited

U.S. PATENT DOCUMENTS 4,995,448 A 2/1991 Inagaki et al.
5,307,865 A 5/1994 Inagaki et al.
(Continued)

FOREIGN PATENT DOCUMENTS

DE 3803546 A1 8/1988
JP H05272321 A 10/1993
JP 2012117456 A 6/2012

OTHER PUBLICATIONS

ISA Japan Patent Office, International Search Report Issued in PCT Application No. PCT/JP2016/001083, dated Apr. 26, 2016, WIPO, 2 pages.

*Primary Examiner* — Long T Tran
*Assistant Examiner* — James J Kim
(74) *Attorney, Agent, or Firm* — Alleman Hall Creasman & Tuttle LLP

(57) ABSTRACT

An object of the present invention is to simplify portions of an oil supply passage which portions are formed at a cylinder block. An oil supply device according to the present invention includes a cylinder block, an oil pan, an oil pump, and an oil filter. Wall portions of the oil pan are coupled to wall portions of the cylinder block. An oil filter is attached to the oil pan. An upstream oil supply passage through which the oil filtrated by the oil filter flows is formed at the oil pan. A downstream oil supply passage including a main gallery extending in a cylinder column direction is formed at the cylinder block. A first communication passage through which the main gallery and the upstream oil supply passage
(Continued)

communicate with each other is formed at the wall portion of the cylinder block and the wall portion of the oil pan.

14 Claims, 12 Drawing Sheets

(51) Int. Cl.

| | |
|---|---|
| ***F01M 1/16*** | (2006.01) |
| ***F01M 11/00*** | (2006.01) |
| ***F01M 1/08*** | (2006.01) |
| ***F01M 11/03*** | (2006.01) |
| ***F01M 1/06*** | (2006.01) |
| ***F01M 1/02*** | (2006.01) |
| ***F01M 1/10*** | (2006.01) |

(52) U.S. Cl.
CPC ..... *F01M 1/10* (2013.01); *F01M 1/16* (2013.01); *F01M 11/00* (2013.01); *F01M 11/0004* (2013.01); *F01M 11/03* (2013.01); *F01M 5/005* (2013.01); *F01M 2001/0238* (2013.01); *F01M 2001/0246* (2013.01); *F01M 2001/0253* (2013.01); *F01M 2001/064* (2013.01); *F01M 2011/0025* (2013.01); *F01M 2011/0029* (2013.01); *F01M 2011/0054* (2013.01); *F01M 2011/0079* (2013.01); *F01M 2011/022* (2013.01); *F01M 2011/026* (2013.01)

(58) Field of Classification Search
CPC ..... F01M 2011/023; F01M 2011/0054; F01L 2001/34426
USPC ..... 123/196 AB, 196 A; 184/106
See application file for complete search history.

(56) References Cited

U.S. PATENT DOCUMENTS

| | | | | |
|---|---|---|---|---|
| 6,058,898 | A * | 5/2000 | Freese | F01M 11/0004 123/195 C |
| 9,828,900 | B2 * | 11/2017 | Takasaki | F01M 1/08 |
| 2002/0124819 | A1 * | 9/2002 | Lunsford | F01L 1/34 123/90.15 |
| 2009/0020366 | A1 * | 1/2009 | Mori | F01M 11/0004 184/106 |
| 2010/0282203 | A1 * | 11/2010 | Jessberger | F01M 11/0004 123/195 C |
| 2013/0312696 | A1 * | 11/2013 | Mordukhovich | F01M 11/0004 123/196 AB |
| 2015/0159525 | A1 * | 6/2015 | Matsuda | F04D 25/028 123/196 A |
| 2015/0252749 | A1 * | 9/2015 | Kobayashi | F01M 11/02 123/193.5 |
| 2016/0341081 | A1 * | 11/2016 | Takama | F01M 1/12 |

* cited by examiner

OIL SUPPLY DEVICE OF ENGINE, METHOD OF MANUFACTURING ENGINE, AND OIL SUPPLY PASSAGE STRUCTURE OF ENGINE

TECHNICAL FIELD

The technology disclosed herein relates to an oil supply device of an engine, a method of manufacturing an engine, and an oil supply passage structure of an engine.

BACKGROUND ART

An oil supply device configured to suck up oil from an oil pan by using an oil pump and supply the oil to respective portions of an engine has been known. For example, in the oil supply device disclosed in PTL 1, a bearing portion of a crank shaft is formed at a cylinder block. The oil sucked up by the oil pump flows through an oil filter and an oil cooler to be supplied to the bearing portion through oil supply passages formed at the cylinder block.

CITATION LIST

Patent Literature

PTL 1: Japanese Laid-Open Patent Application Publication No. 2012-117456

SUMMARY OF INVENTION

Technical Problem

In the engine, the oil is supplied to not only the bearing portion of the crank shaft but also various portions. However, if the oil supply passages formed at the cylinder block are complex, a change of the cylinder block due to changes of specifications regarding the oil supply device becomes complicated.

The technology disclosed herein was made in consideration of these, and an object of the technology disclosed herein is to simplify portions of oil supply passages which portions are formed at a cylinder block.

Solution To Problem

A technology disclosed herein is an oil supply device of an engine, the oil supply device including: a cylinder block including a plurality of cylinder bores lined up in a predetermined cylinder column direction; an oil pan attached to the cylinder block; an oil pump configured to suck up oil from the oil pan and eject the oil; and an oil filter configured to filtrate the oil ejected from the oil pump, wherein: wall portions of the oil pan are coupled to wall portions of the cylinder block; the oil filter is attached to the oil pan; an upstream oil supply passage through which the oil filtrated by the oil filter flows is formed at the oil pan; a downstream oil supply passage including a first oil passage extending in the cylinder column direction is formed at the cylinder block; and a first communication passage through which the first oil passage and the upstream oil supply passage communicate with each other is formed at the wall portions of the cylinder block and the oil pan.

According to this configuration, parts relating to the oil supply device and oil supply passages can be collectively arranged at the oil pan as much as possible, and portions of the oil supply passages which portions are formed at the cylinder block can be simplified. Specifically, the oil filter is attached to the oil pan, and the upstream supply passage is formed at the oil pan. Therefore, regarding the oil supply passages from the oil filter to the first oil passage, at least the first communication passage is only required to be formed at the cylinder block, so that portions of the oil supply passages which portions are formed at the cylinder block can be simplified.

As above, the parts relating to the oil supply device and the oil supply passages are collectively arranged at the oil pan, so that even in a case where specifications of the oil supply device need to be changed due to changes in specifications such as a car segment on which the engine is mounted, the displacement of the engine, and presence or absence of an electric system, it is possible to deal with this case by mainly changing the specifications of the oil pan, and the changes in the specifications of the cylinder block due to the oil supply device can be suppressed as much as possible. Thus, common architecture can be realized.

Further, since the parts relating to the oil supply device and the oil supply passages are collectively arranged at the oil pan, restrictions on the cylinder block due to the oil supply device can be reduced, and the degree of freedom of the layout around the cylinder block can be improved.

The oil supply device may be configured such that the downstream oil supply passage further includes a second oil passage formed at the cylinder block and extending in the cylinder column direction; the first oil passage and the second oil passage are arranged so as to sandwich the cylinder bores; the first communication passage is formed at the wall portion of the cylinder block and the wall portion of the oil pan, these wall portions being located at the same side as the first oil passage with respect to the cylinder bores; a second communication passage through which the second oil passage and the upstream oil supply passage communicate with each other is formed at the wall portion of the cylinder block and the wall portion of the oil pan, these wall portions being located at the same side as the second oil passage with respect to the cylinder bores; a flow control valve configured to control a flow rate of the oil supplied to the second oil passage is connected to the upstream oil supply passage; and the flow control valve is attached to the oil pan.

According to this configuration, even in a case where the first oil passage and the second oil passage are formed at the cylinder block, regarding the oil supply passages from the oil filter to the first oil passage and the second oil passage, at least the first communication passage and the second communication passage are only required to be formed at the cylinder block. The oil supply passages from the oil filter to the first communication passage and the second communication passage are formed at the oil pan. Therefore, portions of the oil supply passages which portions are formed at the cylinder block can be simplified.

In addition, the flow control valve configured to control the flow rate of the oil supplied to the second oil passage is attached to the oil pan. To be specific, as the parts relating to the oil supply device, the oil filter and the flow control valve are collectively arranged at the oil pan. Further, the oil supply passages extending from the oil filter through the flow control valve are formed at the oil pan. With this, the oil supply passages are further collectively arranged at the oil pan.

The oil supply device may be configured such that: branch passages through which the oil is supplied to specific bearing portions of a crank shaft are connected to the first oil passage; and branch passages through which the oil is supplied to bearing portions of the crank shaft other than the specific bearing portions are connected to the second oil passage.

According to this configuration, the oil is supplied from the first oil passage to the bearing portions and from the second oil passage to the different bearing portions.

The oil supply device may be configured such that: the downstream oil supply passage further includes a third oil passage formed at the cylinder block and extending in the cylinder column direction; and oil jets configured to inject the oil to pistons inserted in the cylinder bores are connected to the third oil passage.

The oil supply device may further include: a heat exchanger configured to adjust a temperature of the oil ejected from the oil pump; and a hybrid vehicle transmission including an electric motor, wherein: the heat exchanger and the oil filter may be arranged at the oil pan so as to be located at one side with respect to the cylinder bores; and the transmission may be arranged at the oil pan so as to be located at the other side with respect to the cylinder bores.

According to this configuration, the heat exchanger and the oil filter are arranged at the oil pan so as to be collectively located at one side with respect to the cylinder bores. With this, a space located at a lateral side of the oil pan and at the other side with respect to the cylinder bores can be secured. Then, the transmission can be arranged by effectively utilizing the space.

The oil supply device is configured such that the oil pump is a variable capacity oil pump including a pressure chamber, a capacity of the oil pump being adjusted in accordance with pressure of the pressure chamber, and the oil supply device further includes a capacity control valve configured to adjust pressure of the oil supplied to the pressure chamber, wherein: the capacity control valve is connected in a control oil passage branching from the upstream oil supply passage and connected to the pressure chamber; the capacity control valve is configured to adjust the pressure of the oil supplied to the pressure chamber through the control oil passage; and the capacity control valve is attached to the oil pan.

According to this configuration, the oil filter is attached to the oil pan. Further, as with the oil filter, the capacity control valve is attached to the oil pan. With this, the capacity control valve is easily arranged closer to the oil filter than a case where the capacity control valve is attached to the cylinder block. The capacity control valve is connected in the control oil passage branching from the oil supply passage and connected to the pressure chamber. Therefore, by arranging the capacity control valve close to the oil filter, a portion of the control oil passage which portion extends from the oil supply passage to the capacity control valve can be shortened. Further, since the oil pump is configured to suck up the oil stored in the oil pan, the oil pump is arranged close to the oil pan, such as inside the oil pan. Therefore, by attaching the capacity control valve to the oil pan, the capacity control valve is easily arranged close to the oil pump. With this, a portion of the control oil passage which portion extends from the capacity control valve to the pressure chamber can be shortened. As a result, the control oil passage can be entirely shortened, so that a time until the oil branching from the oil supply passage flows into the pressure chamber is shortened, and therefore, responsiveness of capacity control of the oil pump can be improved.

The capacity control valve may be arranged lower than a level of the oil stored in the oil pan.

According to this configuration, since the capacity control valve is arranged lower than the level of the oil stored in the oil pan, the capacity control valve is being filled with the oil. In a case where the capacity control valve is being filled with the oil when starting the engine, the oil having desired oil pressure can be quickly supplied to the pressure chamber of the oil pump. To be specific, the responsiveness for adjusting the capacity of the oil pump when starting the engine can be improved.

Here, the "level of the oil stored in the oil pan" denotes the level of the oil stored in the oil pan when the engine is normally used, that is, the level corresponding to an engine oil lower limit amount defined for appropriately using the engine.

The oil supply device may be configured such that: the oil pump is attached to the cylinder block; the oil supply passage and the control oil passage are formed at the cylinder block and the oil pan; and by attaching the oil pan to the cylinder block, a portion of the oil supply passage which portion is formed at the cylinder block and a portion of the oil supply passage which portion is formed at the oil pan communicate with each other, and a portion of the control oil passage which portion is formed at the cylinder block and a portion of the control oil passage which portion is formed at the oil pan communicate with each other.

The oil supply device may be configured such that: the oil pump is arranged at the cylinder block so as to be located at one side in the cylinder column direction; and the capacity control valve is attached to the wall portion of the oil pan, the wall portion being located at the one side in the cylinder column direction.

According to this configuration, since both the oil pump and the capacity control valve are arranged at the engine so as to be located at one side in the cylinder column direction, the oil pump and the capacity control valve are arranged close to each other. With this, the control oil passage can be shortened, and the responsiveness of the capacity control of the oil pump can be further improved.

Further, in a case where the oil pump is driven by the crank shaft through a timing chain or a timing belt, the one side in the cylinder column direction where the oil pump is arranged denotes a side in the cylinder column direction where the timing chain or the timing belt is located. To be specific, since the timing chain, the timing belt, or the like is arranged at the wall portion of the cylinder block which portion is located at the one side in the cylinder column direction, it is difficult to arrange the capacity control valve. However, the timing chain or the timing belt is not arranged at the wall portion of the oil pan which portion is located at the one side in the cylinder column direction. Therefore, the capacity control valve can be arranged at the wall portion of the oil pan which portion is located at the one side in the cylinder column direction. To be specific, in a case where the oil pump is arranged close to a timing chain chamber or a timing belt chamber in the cylinder column direction by attaching the capacity control valve to the oil pan, the capacity control valve can be attached to the wall portion located at one side in the cylinder column direction where the timing chain or the timing belt is arranged. As a result, the capacity control valve can be arranged close to the oil pump.

The oil filter may be attached to a portion of the oil pan which portion is located at the one side in the cylinder column direction.

According to this configuration, since the oil filter is also arranged at the engine so as to be located at the one side in the cylinder column direction, the capacity control valve and the oil filter are arranged close to each other. With this, the control oil passage can be shortened, and the responsiveness of the capacity control of the oil pump can be further improved.

The oil supply device may further include an oil pressure detecting portion configured to detect the pressure of the oil flowing through the oil supply passage, wherein the capacity control valve may adjust the pressure of the oil, supplied to the pressure chamber, in accordance with the pressure detected by the oil pressure detecting portion.

The oil supply device is configured such that: the oil pump is arranged in the oil pan so as to be located at one side in the cylinder column direction; and a part of the upstream oil supply passage which part couples a portion of the upstream oil supply passage which portion is connected to the first communication passage and a portion of the upstream oil supply passage which portion is connected to the second communication passage is formed so as to extend through the wall portion of the oil pan, the wall portion being located at the other side of the oil pump in the cylinder column direction.

Here, "located at one side in the cylinder column direction" denotes "located at any side of a cylinder column direction middle of the oil pan." The oil pump is coupled to a crank shaft, a camshaft, or the like through a timing chain, a timing belt, or a gear and is driven by the crank shaft, the camshaft, or the like. By arranging the oil pump in the oil pan so as to be located at one side in the cylinder column direction, the oil pump and the crank shaft or the like can be coupled to each other at the one side in the cylinder column direction. In this case, at the one side of the oil pan in the cylinder column direction, a mechanism (such as a sprocket around which the timing chain winds) for coupling, for example, the oil pump and the crank shaft, and the like are arranged in addition to the oil pump.

To form the oil supply passages of the wall portions of the oil pan, it is necessary to increase the thicknesses of the wall portions for the formation of the oil supply passages. In a case where the mechanism for coupling the oil pump and the crank shaft or the like is arranged at the oil pan so as to be located at one side in the cylinder column direction, a space at the other side of the oil pump of the oil pan in the cylinder column direction is wider than a space at one side of the oil pan in the cylinder column direction. Therefore, in a case where the upstream oil supply passage is formed at the other side of the oil pump of the oil pan in the cylinder column direction, the upstream oil supply passage can be arranged with a high degree of freedom. Especially, as described above, in a case where the communication passages through which the upstream oil supply passage and the downstream oil supply passage communicate with each other are formed at the wall portions of the cylinder block which portions sandwich the plurality of cylinder bores and the wall portions of the oil pan which portions sandwich the plurality of cylinder bores, the upstream oil supply passage needs to extend from the wall portion of the oil pan which portion is located at one side of the cylinder bores to the wall portion at the other side. Therefore, at least a part of the upstream oil supply passage which part couples a portion of the upstream oil supply passage which portion is connected to the first communication passage and a portion of the upstream oil supply passage which portion is connected to the second communication passage is formed so as to extend through the wall portion of the oil pan which portion is located at the other side of the oil pump in the cylinder column direction. With this, this part of the upstream oil supply passage can be easily arranged with a high degree of freedom. If the degree of freedom of the arrangement can be improved as above, the upstream oil supply passage can be arranged such that machine work of the upstream oil supply passage and formation of a hole of the upstream oil supply passage by casting are easily performed.

The oil supply device may be configured such that: the cylinder block has a division structure constituted by an upper block and a lower block; the lower block is fastened to the upper block by bolts at plural positions; the first oil passage and the second oil passage are formed at the upper block; a portion of the first communication passage which portion is formed at the cylinder block penetrates the lower block and is formed at the upper block at a position between adjacent bolt fastened portions to reach the first oil passage; and a portion of the second communication passage which portion is formed at the cylinder block penetrates the lower block and is formed at the upper block at a position between adjacent bolt fastened portions to reach the second oil passage.

According to this configuration, a portion of the first communication passage which portion is formed at the cylinder block is arranged at a position between adjacent bolt fastened portions, and a portion of the second communication passage which portion is formed at the cylinder block is arranged at a position between adjacent bolt fastened portions. To be specific, the first communication passage and the second communication passage are formed at portions where the seal performance between the upper block and the lower block is high. With this, oil leakage can be suppressed at a coupling portion where a portion of the first communication passage which portion is formed at the upper block and a portion of the first communication passage which portion is formed at the lower block are coupled to each other and a coupling portion where a portion of the second communication passage which portion is formed at the upper block and a portion of the second communication passage which portion is formed at the lower block are coupled to each other.

The oil supply device may be configured such that: the downstream oil supply passage further includes a second oil passage formed at the cylinder block and extending in the cylinder column direction; the first oil passage and the second oil passage are arranged so as to sandwich the cylinder bores; the first communication passage is formed at the wall portion of the cylinder block and the wall portion of the oil pan, these wall portions being arranged at the same side as the first oil passage with respect to the cylinder bores; a second communication passage through which the second oil passage and the upstream oil supply passage communicate with each other is formed at the wall portion of the cylinder block and the wall portion of the oil pan, these wall portions being arranged at the same side as the second oil passage with respect to the cylinder bores; a heat exchanger configured to adjust a temperature of the oil ejected from the oil pump is arranged at the wall portion of the oil pan, the wall portion being arranged at the same side as the first oil passage with respect to the cylinder bores; and a flow control valve configured to control a flow rate of the oil supplied to the second oil passage through the second communication passage is arranged at the wall portion of the oil pan, the wall portion being arranged at the same side as the second oil passage with respect to the cylinder bores.

According to this configuration, by attaching the heat exchanger and the flow control valve to the oil pan, it becomes unnecessary to attach the heat exchanger and the flow control valve to the cylinder block, so that a space for arranging the other auxiliary devices can be secured around the cylinder block. Further, the heat exchanger is arranged at one wall portion of the oil pan, and the flow control valve is arranged at another wall portion of the oil pan. To be specific, the heat exchanger and the flow control valve are not collectively arranged at one wall portion of the oil pan but are arranged at different wall portions of the oil pan. With this, the degree of freedom of the arrangement can be improved, and the space around the oil pan can be effectively utilized.

In addition, by attaching the heat exchanger and the flow control valve to the oil pan, the auxiliary devices relating to the oil supply device can be collectively arranged at the oil pan. The oil supply passages to which these auxiliary devices are connected are mainly formed at the oil pan. Therefore, the oil supply passages formed at the cylinder block can be simplified. Further, the auxiliary devices relating to the oil supply device and the oil supply passages to which the auxiliary devices are connected are collectively arranged at the oil pan, so that even in a case where the specifications of the oil supply device need to be changed due to the changes in the specifications such as the car segment on which the engine is mounted, the displacement of the engine, and the presence or absence of the electric system, it is possible to deal with this case by mainly changing the specifications of the oil pan. Thus, the changes in the specifications of the cylinder block can be suppressed as much as possible.

The heat exchanger may be arranged lower than a level of the oil stored in the oil pan.

According to the above configuration, the thickness of the wall portion of the oil pan needs to be increased to such a degree that the upstream oil supply passage can be formed at the wall portion of the oil pan. In a case where the outer shape of the oil pan is restricted, to be specific, the size of the oil pan is restricted, the capacity of the oil pan decreases by the increase in the thickness of the wall portion of the oil pan. However, since the oil can also be stored in the heat exchanger by arranging the heat exchanger lower than the level of the oil in the oil pan, an oil storage amount can be secured. To be specific, the heat exchanger allows the oil to flow therein and adjusts the temperature of the oil by heat exchange with the flowing oil. To be specific, the heat exchanger also has an ability of storing the oil. Therefore, by arranging the heat exchanger lower than the level of the oil in the oil pan, a state where the heat exchanger is filled with the oil can be maintained, to be specific, a state where the heat exchanger stores the oil can be maintained. As a result, the oil storage amount of the oil pan can be compensated by the heat exchanger.

Another technology disclosed herein is a method of manufacturing an engine, the engine including: a cylinder block including a plurality of cylinder bores lined up in a predetermined cylinder column direction; an oil pan attached to the cylinder block; and an oil pump configured to suck up oil from the oil pan and eject the oil, the method including: forming a downstream oil supply passage at the cylinder block, the downstream oil supply passage including a first oil passage and a second oil passage, the first oil passage being arranged at one side with respect to the plurality of cylinder bores and extending in the cylinder column direction, the second oil passage being arranged at the other side with respect to the plurality of cylinder bores and extending in the cylinder column direction; forming an upstream portion of a first communication passage, the upstream portion being open at a joining portion of the cylinder block which portion is joined to the oil pan, the upstream portion being arranged at the same side as the first oil passage with respect to the plurality of cylinder bores, the upstream portion communicating with the first oil passage; forming an upstream portion of a second communication passage, the upstream portion being open at the joining portion of the cylinder block which portion is joined to the oil pan, the upstream portion being arranged at the same side as the second oil passage with respect to the plurality of cylinder bores, the upstream portion communicating with the second oil passage; forming an upstream oil supply passage at the oil pan, the oil being ejected from the oil pump to flow through the upstream oil supply passage; forming a downstream portion of the first communication passage at the oil pan, the downstream portion being open at a joining portion of the oil pan which portion is joined to the cylinder block, the downstream portion communicating with the upstream oil supply passage and being communicable with the upstream portion of the first communication passage; forming a downstream portion of the second communication passage at the oil pan, the downstream portion being open at the joining portion of the oil pan which portion is joined to the cylinder block, the downstream portion communicating with the upstream oil supply passage and being communicable with the upstream portion of the second communication passage; combining the joining portion of the oil pan and the joining portion of the cylinder block to cause the upstream portion of the first communication passage and the downstream portion of the first communication passage to communicate with each other and also cause the upstream portion of the second communication passage and the downstream portion of the second communication passage to communicate with each other; and setting a position of the first communication passage with respect to the plurality of cylinder bores and a position of the second communication passage with respect to the plurality of cylinder bores such that these positions are common among engines which are different in displacement from one another.

Further, still another technology disclosed herein is an oil supply passage structure of an engine, the engine including: a cylinder block including a plurality of cylinder bores lined up in a predetermined cylinder column direction; an oil pan attached to the cylinder block; and an oil pump configured to suck up oil from the oil pan and eject the oil, wherein: an upstream oil supply passage through which the oil ejected from the oil pump flows is formed at the oil pan; a downstream oil supply passage including a first oil passage and a second oil passage is formed at the cylinder block, the first oil passage being arranged at one side with respect to the plurality of cylinder bores and extending in the cylinder column direction, the second oil passage being arranged at the other side with respect to the plurality of cylinder bores and extending in the cylinder column direction; wall portions of the oil pan are coupled to wall portions of the cylinder block; a first communication passage through which the upstream oil supply passage and the first oil passage communicate with each other is formed at the wall portion of the cylinder block and the wall portion of the oil pan, these wall portions being arranged at the same side as the first oil passage with respect to the plurality of cylinder bores; a second communication passage through which the upstream oil supply passage and the second oil passage communicate with each other is formed at the wall portion of the cylinder block and the wall portion of the oil pan, these wall portions being arranged at the same side as the second oil passage with respect to the plurality of cylinder bores; and a position of the first communication passage with respect to the plurality of cylinder bores and a position of the second communication passage with respect to the plurality of cylinder bores are set such that these positions are common among engines which are different in displacement from one another.

Here, "a position of the first communication passage with respect to the plurality of cylinder bores and a position of the second communication passage with respect to the plurality of cylinder bores are set such that these positions are common" denotes that the position of the first communication passage with respect to a specific cylinder bore (for example, the cylinder bore of the first cylinder) and the position of the second communication passage with respect to the specific cylinder bore are common among the engines which are different in displacement from one another or denotes that the positions of the first communication passage and the second communication passage between how-manieth cylinder bores from one side in the cylinder column direction are common (for example, the positions of the first communication passage and the second communication passage between the cylinder bore of the second cylinder and the cylinder bore of the third cylinder are common) among the engines which are different in displacement from one another (in this case, strict positions of the first communication passage and the second communication passage between two adjacent cylinder bores do not matter).

According to these configurations, the parts relating to the oil supply device and the oil supply passages are collectively arranged at the oil pan as much as possible, and the portions of the oil supply passages which portions are formed at the cylinder block can be simplified. Specifically, the oil filter is attached to the oil pan, and the upstream supply passage is formed at the oil pan. On the other hand, the first oil passage and the second oil passage arranged so as to sandwich the plurality of cylinder bores are formed at the cylinder block. Then, regarding the oil supply passages from the oil filter to the first oil passage and the second oil passage, at least the first communication passage and the second communication passage are only required to be formed at the cylinder block, so that the portions of the oil supply passages which portions are formed at the cylinder block can be simplified.

The first communication passage is formed at the wall portion of the cylinder block and the wall portion of the oil pan, these wall portions being arranged at the same side as the first oil passage with respect to the plurality of cylinder bores. Further, the second communication passage is formed at the wall portion of the cylinder block and the wall portion of the oil pan, these wall portions being arranged at the same side as the second oil passage with respect to the plurality of cylinder bores. Then, by attaching the oil pan to the cylinder block, the upstream portion of the first communication passage and the downstream portion of the first communication passage communicate with each other, and the upstream portion of the second communication passage and the downstream portion of the second communication passage communicate with each other. As above, only by attaching the oil pan to the cylinder block, the upstream oil supply passage and the downstream oil supply passage can be easily formed.

In addition, the position of the first communication passage with respect to the plurality of cylinder bores and the position of the second communication passage with respect to the plurality of cylinder bores are set to be common among the engines which are different in displacement from one another. With this, even in the case of changing designs of the upstream oil supply passage and the downstream oil supply passage due to the change in the displacement, the positions of the first communication passage and the second communication passage with respect to the plurality of cylinder bores are common. As above, the positions of the first communication passage and the second communication passage are common, so that even in a case where the configuration of the upstream oil supply passage or the downstream oil supply passage is changed, a communication structure between the upstream oil supply passage and the downstream oil supply passage by the attachment of the oil pan to the cylinder block is maintained. Further, the oil supply passages are collectively arranged at the oil pan, and the positions of the first communication passage and the second communication passage are common, so that regarding the oil supply passages formed at the cylinder block, the downstream oil supply passage is only required to be changed in accordance with the change in the displacement. As above, the change of the cylinder block due to the oil supply device can be suppressed as much as possible. With this, the common architecture can be realized.

Advantageous Effects of Invention

According to the oil supply device of the engine, portions of the oil supply passages which portions are formed at the cylinder block can be simplified.

According to the method of manufacturing the engine, portions of the oil supply passages which portions are formed at the cylinder block can be simplified. Further, in each of the engines which are different in displacement from one another, setting (design) of the upstream oil supply passage of the oil pan and the downstream oil supply passage of the cylinder block can be simplified in a short period of time. In addition, a step of positioning and assembling the oil pan and the cylinder block is made common among the engines, and assembly workability can also be improved.

According to the oil supply passage structure of the engine, portions of the oil supply passages which portions are formed at the cylinder block can be simplified, and in each of the engines which are different in displacement from one another, setting (design) of the upstream oil supply passage of the oil pan and the downstream oil supply passage of the cylinder block can be simplified in a short period of time.

DESCRIPTION OF EMBODIMENTS

Hereinafter, an exemplary embodiment will be explained in detail based on the drawings.

Figure 1:
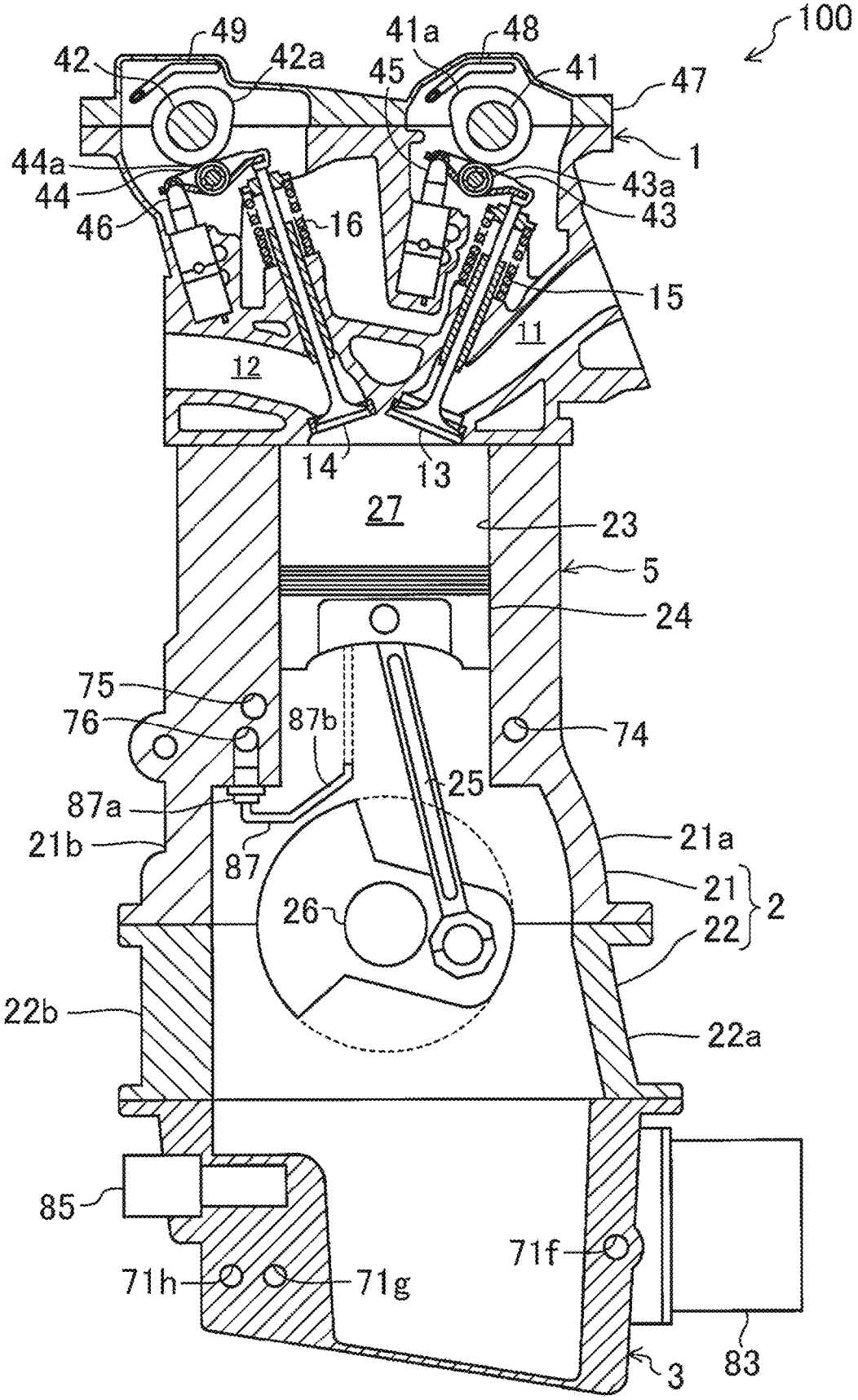
FIG. 1 is a schematic sectional view showing an engine and taken along a plane including a center axis of a cylinder.
Figure 2:
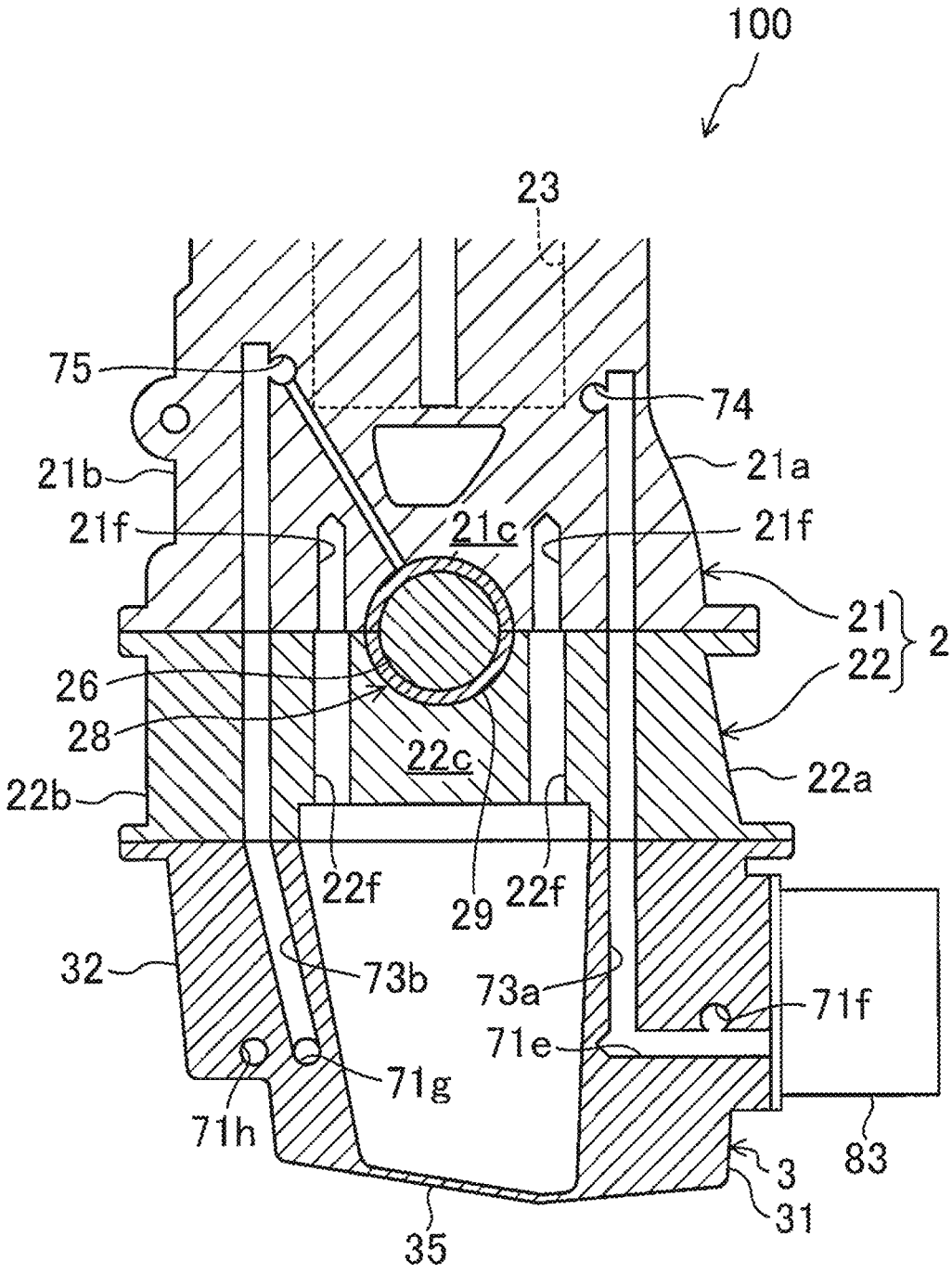
FIG. 2 is a schematic sectional view showing the engine and taken along a plane of a portion between two cylinder bores.
Figure 3:
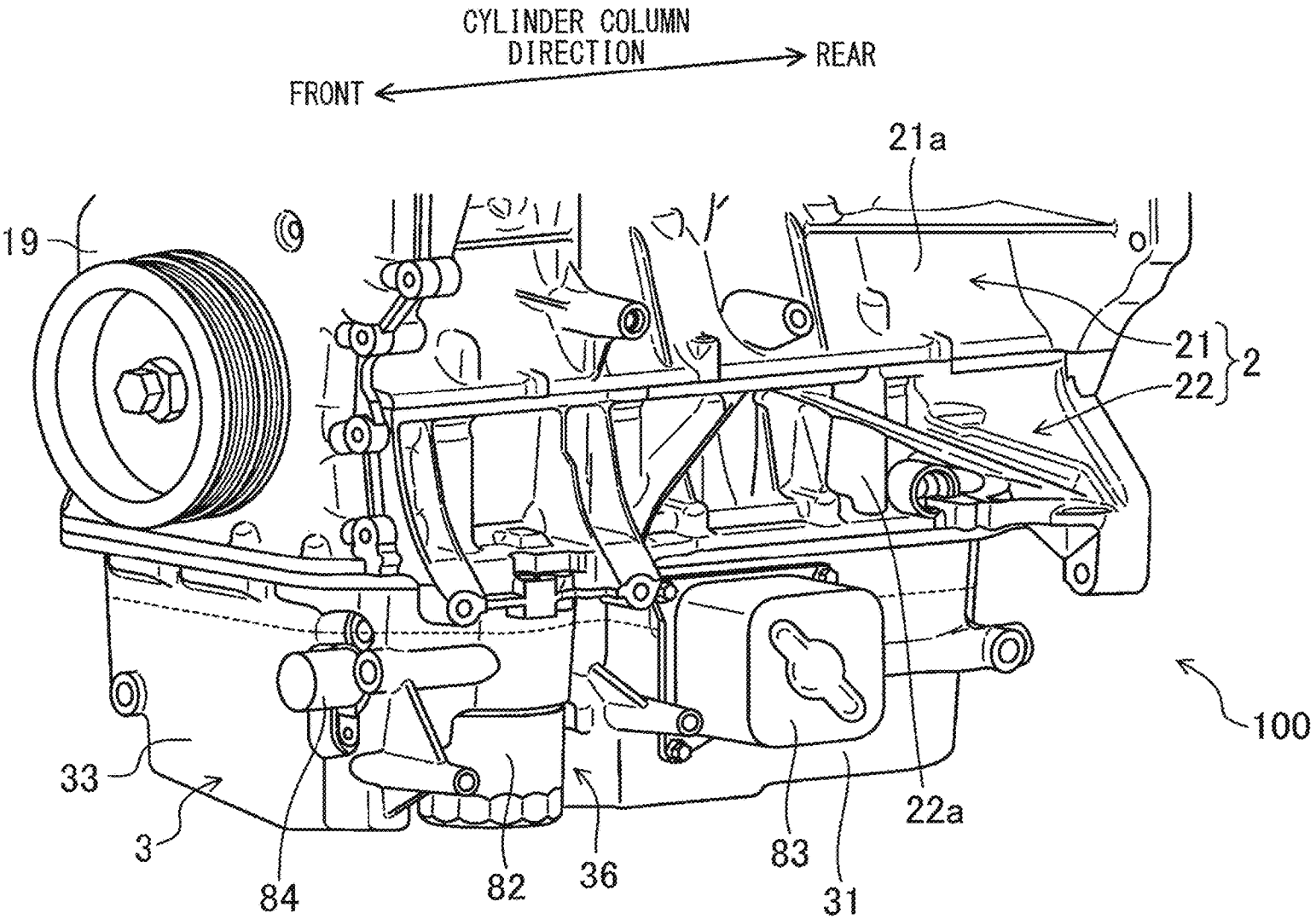
FIG. 3 is a perspective view mainly showing a lower portion of the engine.

FIG. 1 is a schematic sectional view showing an engine 100 and taken along a plane including a center axis of a cylinder. FIG. 2 is a schematic sectional view showing the engine 100 and taken along a plane of a portion between two cylinder bores. FIG. 3 is a perspective view mainly showing a lower portion of the engine 100. In the present description, for convenience of explanation, a cylinder center axis direction is referred to as an upward/downward direction, and a cylinder column direction is referred to as a forward/rearward direction. Further, regarding the cylinder column direction, one side of the engine 100 at which side a transmission is not provided is referred to as a front side, and the other side of the engine 100 at which side the transmission is provided is referred to as a rear side.

The engine 100 is an inline four cylinder engine in which four cylinders are arranged to be lined up in a predetermined cylinder column direction. The engine 100 includes a cylinder head 1, a cylinder block 2 attached to the cylinder head 1, and an oil pan 3 attached to the cylinder block 2.

The cylinder block 2 includes an upper block 21 and a lower block 22. The lower block 22 is attached to a lower surface of the upper block 21. The oil pan 3 is attached to a lower surface of the lower block 22.

Four cylinder bores 23 corresponding to the four cylinders are formed at the upper block 21 so as to be lined up in the cylinder column direction (FIG. 1 shows only one cylinder bore 23). The cylinder bores 23 are formed at an upper portion of the upper block 21, and a lower portion of the upper block 21 defines a part of a crank chamber. Pistons 24 are inserted in the cylinder bores 23. The pistons 24 are coupled to a crank shaft 26 through connecting rods 25. The cylinder bores 23, the pistons 24, and the cylinder head 1 define combustion chambers 27. It should be noted that: the four cylinder bores 23 correspond to a first cylinder, a second cylinder, a third cylinder, and a fourth cylinder arranged in this order from the front side; and when distinguishing these four cylinder bores 23, the four cylinder bores 23 are referred to as a first cylinder bore 23A, a second cylinder bore 23B, a third cylinder bore 23C, and a fourth cylinder bore 23D.

The cylinder head 1 includes intake ports 11 and exhaust ports 12 which are open at the combustion chambers 27. Intake valves 13 each configured to open and close the intake port 11 are provided at the intake ports 11. Exhaust valves 14 each configured to open and close the exhaust port 12 are provided at the exhaust ports 12. Each of the intake valves 13 is driven by a cam portion 41*a* of a camshaft 41, and each of the exhaust valves 14 is driven by a cam portion 42*a* of a camshaft 42.

Specifically, the intake valve 13 is being biased by a valve spring 15 in a closing direction (upper direction in FIG. 1), and the exhaust valve 14 is biased by a valve spring 16 in the closing direction. A swing arm 43 is interposed between the intake valve 13 and the cam portion 41*a*, and a swing arm 44 is interposed between the exhaust valve 14 and the cam portion 42*a*. One end portion of the swing arm 43 is supported by a hydraulic lash adjuster (hereinafter referred to as a "HLA") 45, and one end portion of the swing arm 44 is supported by a HLA 46. When a cam follower 43*a* provided at a substantially middle portion of the swing arm 43 is pushed by the cam portion 41*a*, the swing arm 43 swings using, as a fulcrum, the end portion supported by the HLA 45. Similarly, when a cam follower 44*a* provided at a substantially middle portion of the swing arm 44 is pushed by the cam portion 42*a*, the swing arm 44 swings using, as a fulcrum, the end portion supported by the HLA 46. When the swing arms 43 and 44 swing as above, the other end portion of the swing arm 43 causes the intake valve 13 to move in an opening direction (lower direction in FIG. 1) against biasing force of the valve spring 15, and the other end portion of the swing arm 44 causes the exhaust valve 14 to move in the opening direction against biasing force of the valve spring 16. Each of the HLAs 45 and 46 automatically adjusts a valve clearance to zero by oil pressure. It should be noted that each of the HLAs 45 and 46 provided at the first cylinder and the fourth cylinder includes a valve stop mechanism configured to stop an operation of the intake valve 13 or the exhaust valve 14. A cam cap 47 is attached to an upper portion of the cylinder head 1. The camshafts 41 and 42 are supported by the cylinder head 1 and the cam cap 47 so as to be rotatable.

An intake-side oil shower 48 is provided above the intake-side camshaft 41, and an exhaust-side oil shower 49 is provided above the exhaust-side camshaft 42. The intake-side oil shower 48 is configured to drop the oil to a contact portion where the cam portion 41*a* and the cam follower 43*a* of the swing arm 43 contact each other, and the exhaust-side oil shower 49 is configured to drop the oil to a contact portion where the cam portion 42*a* and the cam follower 44*a* of the swing arm 44 contact each other.

The engine 100 is provided with a variable valve timing mechanism (hereinafter referred to as a "VVT") 17 configured to change a valve characteristic of the intake valve 13 and a VVT 18 configured to change a valve characteristic of the exhaust valve 14 (see FIG. 6). The VVT 17 is a hydraulic type, and the VVT 18 is an electric type.

The upper block 21 includes: a first side wall 21*a* located at an intake side with respect to the four cylinder bores 23; a second side wall 21*b* located at an exhaust side with respect to the four cylinder bores 23; a front wall 21*d* (shown only in FIG. 5) located at the front side of the first cylinder bore 23A; a rear wall 21*e* (shown only in FIG. 5) located at the rear side of the fourth cylinder bore 23D; and a plurality of vertical walls 21*c* each located at a portion between two adjacent cylinder bores 23 and spreading in the upward/downward direction.

The lower block 22 includes: a first side wall 22*a* corresponding to the first side wall 21*a* of the upper block 21 and located at the intake side; a second side wall 22*b* corresponding to the second side wall 21*b* of the upper block 21 and located at the exhaust side; a front wall 22*d* (shown only in FIG. 5) corresponding to the front wall of the upper block 21 and located at the front side; a rear wall 22*e* (shown only in FIG. 5) corresponding to the rear wall of the upper block 21 and located at the rear side; and a plurality of vertical walls 22*c* corresponding to the vertical walls 21*c* of the upper block 21.

The upper block 21 and the lower block 22 are fastened to each other by bolts. Specifically, the first side wall 21*a* and the first side wall 22*a* are fastened to each other by bolts, the second side wall 21*b* and the second side wall 22*b* are fastened to each other by bolts, the front walls are fastened to each other by bolts, the rear walls are fastened to each other by bolts, and the vertical walls 21*c* and the vertical walls 22*c* are fastened to each other by bolts. Bolt insertion holes 22*f* are formed at the first side wall 22*a*, second side wall 22*b*, front wall, rear wall, and vertical walls 22*c* of the lower block 22 so as to penetrate these walls of the lower block 22, and screw holes 21*f* are formed at the first side wall 21*a*, second side wall 21*b*, front wall, rear wall, and vertical walls 21*c* of the upper block 21 (FIG. 2 shows the screw holes 21*f* of the vertical wall 21*c* and the bolt insertion holes 22*f* of the vertical wall 22*c*). The screw holes 21*f* are formed at the first side wall 21*a* in the cylinder column direction, and the bolt insertion holes 22*f* are formed at the first side wall 22*a* in the cylinder column direction. The screw holes 21*f* are formed at the second side wall 21*b* in the cylinder column direction, and the bolt insertion holes 22*f* are formed at the second side wall 22*b* in the cylinder column direction. Two screw holes 21*f* are formed at each of the front wall, rear wall, and vertical wall 21*c* of the upper block 21, and two bolt insertion holes 22*f* are formed at each of the front wall, rear wall, vertical walls 22*c* of the lower block 22.

Figure 4:
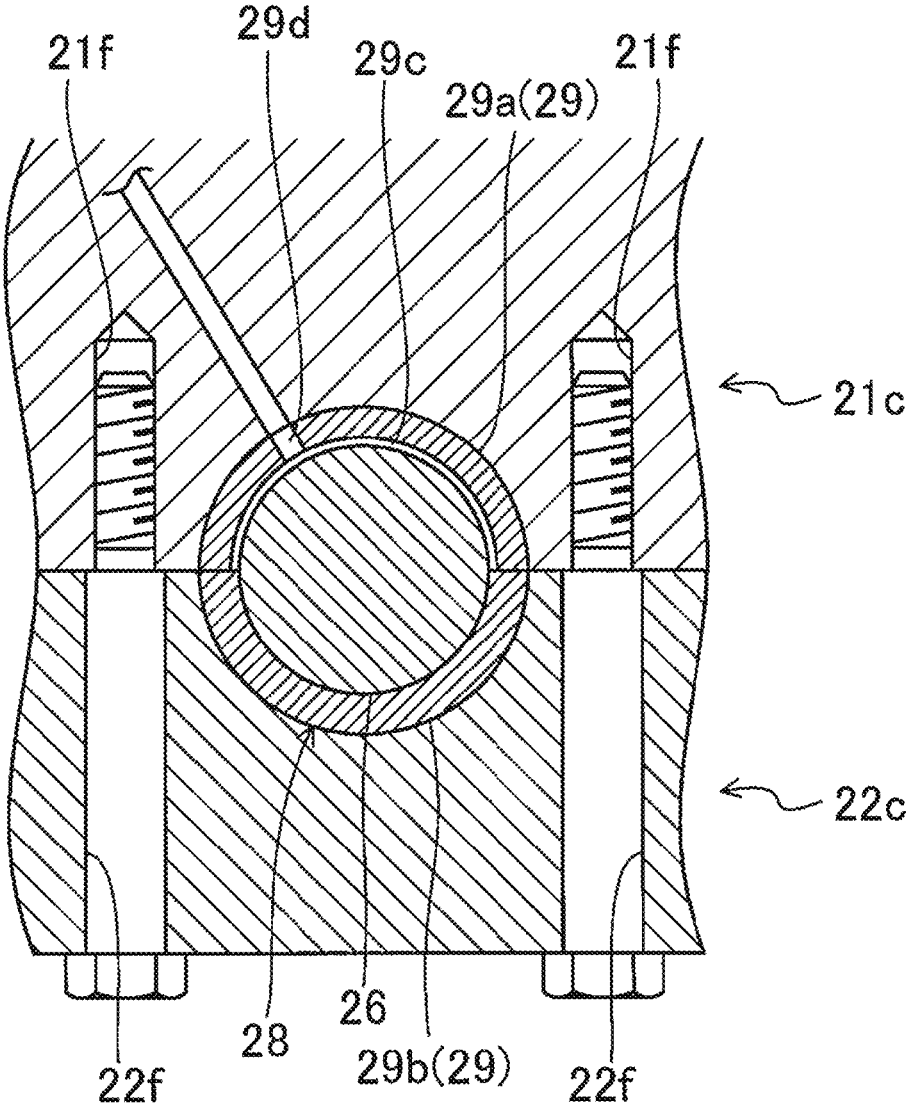
FIG. 4 is a sectional view showing a vertical wall of an upper block and a vertical wall of a lower block, the vertical walls being located at a middle in a cylinder column direction.

FIG. 4 is a sectional view showing the vertical wall 21*c* of the upper block 21 and the vertical wall 22*c* of the lower block 22, the vertical walls 21*c* and 22*c* being located at a middle in the cylinder column direction.

Bearing portions 28 supporting the crank shaft 26 are provided between the front wall of the upper block 21 and the front wall of the lower block 22, between the rear wall of the upper block 21 and the rear wall of the lower block 22, and between each vertical wall 21*c* and each vertical wall 22*c*. Each of the bearing portions 28 is arranged between a pair of holes that are the screw hole 21*f* and the bolt insertion hole 22*f*. The bearing portion 28 includes a cylindrical bearing metal 29. A semi-circular cutout portion is formed at each of a joint portion of the vertical wall 21*c* and a joint portion of the vertical wall 22*c*. The bearing metal 29 has a division structure constituted by a first semi-circular portion 29*a* and a second semi-circular portion 29*b*. The first semi-circular portion 29*a* is attached to the cutout portion of the vertical wall 21*c*, and the second semi-circular portion 29*b* is attached to the cutout portion of the vertical wall 22*c*. By coupling the vertical wall 21*c* and the vertical wall 22*c*, the first semi-circular portion 29*a* and the second semi-circular portion 29*b* are coupled to each other to form a cylindrical shape. An oil groove 29*c* is formed on an inner peripheral surface of the first semi-circular portion 29*a* so as to extend in a circumferential direction. In addition, a communication passage 29*d* is formed at the first semi-circular portion 29*a* so as to penetrate the first semi-circular portion 29*a*. The communication passage 29*d* includes: one end that is open on an outer peripheral surface of the first semi-circular portion 29*a*; and the other end that is open on the oil groove 29*c*. Although details will be described later, the oil is supplied to the outer peripheral surface of the first semi-circular portion 29*a* through an oil supply passage, and the communication passage 29*d* is arranged at such a position as to communicate with this oil supply passage. With this, the oil supplied from the oil supply passage flows through the communication passage 29*d* into the oil groove 29*c*.

It should be noted that the same bearing portions 28 as above are also provided between the front wall of the upper block 21 and the front wall of the lower block 22 and between the rear wall of the upper block 21 and the rear wall of the lower block 22. When distinguishing these bearing portions 28, these bearing portions 28 are referred to as a first bearing portion 28A, a second bearing portion 28B, a third bearing portion 28C, a fourth bearing portion 28D, and a fifth bearing portion 28E arranged in this order from the front side.

Figure 5:
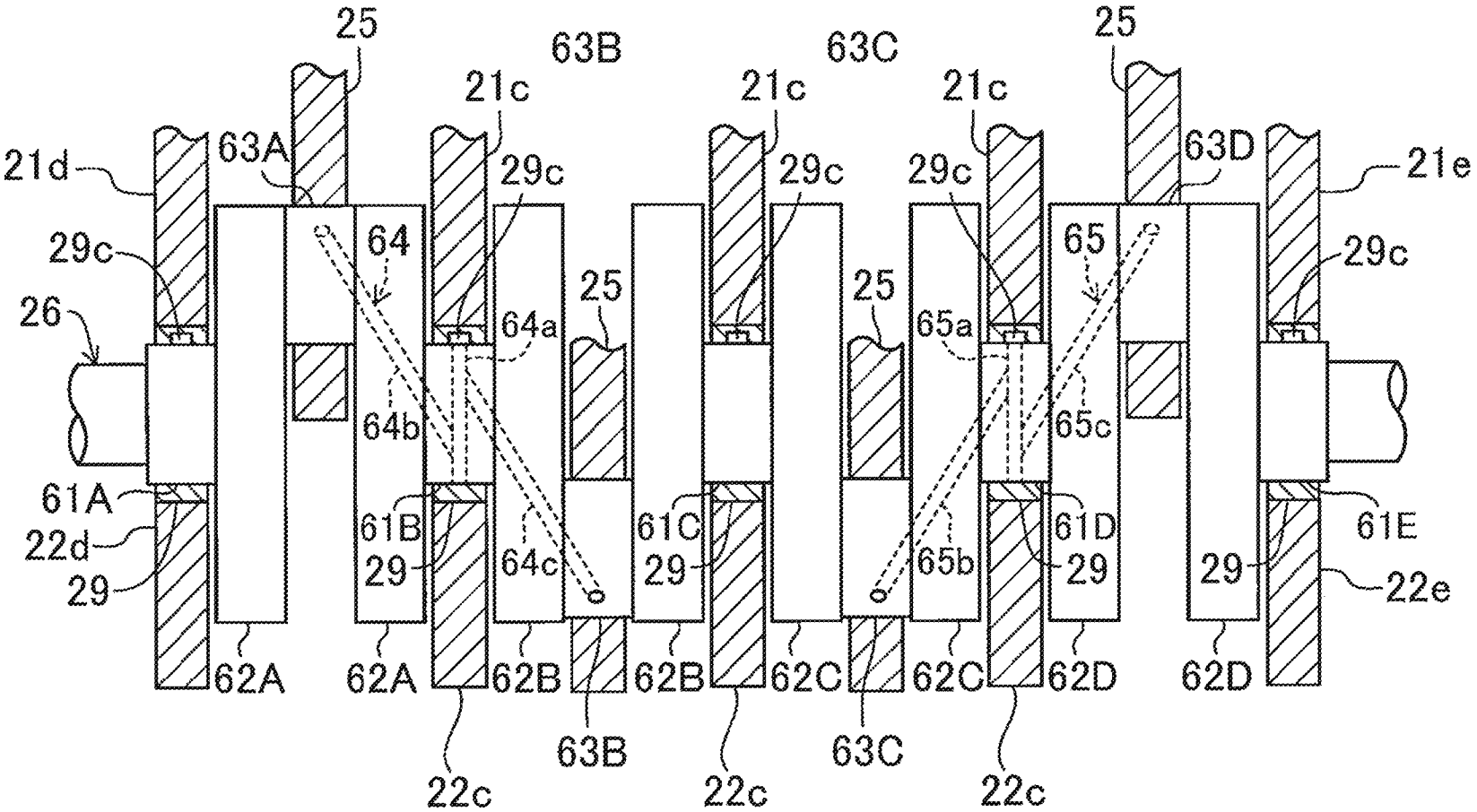
FIG. 5 is a longitudinal sectional view of a crank shaft.

FIG. 5 is a longitudinal sectional view showing the crank shaft 26. The crank shaft 26 includes: journals 61 supported by the bearing portions 28; crank webs 62; and crank pins 63 to which the connecting rods 25 are coupled.

The journals 61 are provided at five positions so as to correspond to the number of bearing portions 28. When distinguishing the journals 61, the journals 61 are referred to as a first journal 61A, a second journal 61B, a third journal 61C, a fourth journal 61D, and a fifth journal 61E arranged in this order from the front side.

Two crank webs 62 form a pair, and pairs of crank webs 62 are provided for the respective cylinder bores 23. To be specific, four pairs of crank webs 62 are provided so as to correspond to the number of cylinder bores 23. When distinguishing the crank webs 62, the crank webs 62 are referred to as first crank webs 62A, second crank webs 62B, third crank webs 62C, and fourth crank webs 62D arranged in this order from the front side.

The crank pins 63 are provided for the respective cylinder bores 23. To be specific, four crank pins 63 are provided so as to correspond to the number of cylinder bores 23. Each of the crank pins 63 is provided between the corresponding pair of crank webs 62. When distinguishing the crank pins 63, the crank pins 63 are referred to as a first crank pin 63A, a second crank pin 63B, a third crank pin 63C, and a fourth crank pin 63D arranged in this order from the front side. The connecting rods 25 are coupled to the respective crank pins 63 so as to be rotatable.

A first communication passage 64 and a second communication passage 65 are formed at the crank shaft 26. The oil supplied to the second bearing portion 28B is supplied to the first crank pin 63A and the second crank pin 63B through the first communication passage 64, and the oil supplied to the fourth bearing portion 28D is supplied to the third crank pin 63C and the fourth crank pin 63D through the second communication passage 65.

The first communication passage 64 includes: a first oil supply passage 64*a* penetrating the second journal 61B in a radial direction; a second oil supply passage 64*b* having one end connected to the first oil supply passage 64*a* and the other end that is open on an outer peripheral surface of the first crank pin 63A; and a third oil supply passage 64*c* having one end connected to the first oil supply passage 64*a* and the other end that is open on an outer peripheral surface of the second crank pin 63B. The second oil supply passage 64*b* penetrates the first crank web 62A that is one of the pair of first crank webs 62A and located close to the second journal 61B. The third oil supply passage 64*c* penetrates the second crank web 62B that is one of the pair of second crank webs 62B and located close to the second journal 61B.

The second communication passage 65 includes: a first oil supply passage 65*a* penetrating the fourth journal 61D in a radial direction; a second oil supply passage 65*b* having one end connected to the first oil supply passage 65*a* and the other end that is open on an outer peripheral surface of the third crank pin 63C; and a third oil supply passage 65*c* having one end connected to the first oil supply passage 65*a* and the other end that is open on an outer peripheral surface of the fourth crank pin 63D. The second oil supply passage 65*b* penetrates the third crank web 62C that is one of the pair of third crank webs 62C and located close to the fourth journal 61D. The third oil supply passage 65*c* penetrates the fourth crank web 62D that is one of the pair of fourth crank webs 62D and located close to the fourth journal 61D.

In the crank shaft 26 configured as above, the journals 61 and the crank pins 63 are lubricated through the bearing portions 28.

Specifically, as described above, the oil is supplied to the bearing portions 28, and the oil is filled in the oil grooves 29*c* on the inner peripheral surfaces of the bearing metals 29. The inner peripheral surfaces of the bearing metals 29 are sliding surfaces on which the journals 61 slide. Therefore, the journals 61 are lubricated when the journals 61 slide on the bearing metals 29.

The first oil supply passage 64*a* of the first communication passage 64 is open on an outer peripheral surface of the second journal 61B. Therefore, the oil supplied to the outer peripheral surface of the second journal 61B flows into the first communication passage 64 through the first oil supply passage 64*a*. The second oil supply passage 64*b* and the third oil supply passage 64*c* branch from the first oil supply passage 64*a*. A downstream end of the second oil supply passage 64*b* is open on the outer peripheral surface of the first crank pin 63A, and a downstream end of the third oil supply passage 64*c* is open on the outer peripheral surface of the second crank pin 63B. To be specific, the oil supplied to the outer peripheral surface of the second journal 61B is supplied through the first communication passage 64 to the outer peripheral surface of the first crank pin 63A and the outer peripheral surface of the second crank pin 63B. Thus, the first crank pin 63A and the second crank pin 63B are lubricated.

Similarly, the first oil supply passage 65*a* of the second communication passage 65 is open on an outer peripheral surface of the fourth journal 61D. Therefore, the oil supplied to the outer peripheral surface of the fourth journal 61D flows into the second communication passage 65 through the first oil supply passage 65*a*. The second oil supply passage 65*b* and the third oil supply passage 65*c* branch from the first oil supply passage 65*a*. A downstream end of the second oil supply passage 65*b* is open on the outer peripheral surface of the third crank pin 63C, and a downstream end of the third oil supply passage 65*c* is open on the outer peripheral surface of the fourth crank pin 63D. To be specific, the oil supplied to the outer peripheral surface of the fourth journal 61D is supplied through the second communication passage 65 to the outer peripheral surface of the third crank pin 63C and the outer peripheral surface of the fourth crank pin 63D. Thus, the third crank pin 63C and the fourth crank pin 63D are lubricated.

As shown in FIG. 3, a chain cover 19 is attached to a front wall of the cylinder block 2. A drive sprocket provided at the crank shaft 26, a timing chain winding around the drive sprocket, and a chain tensioner applying tensile force to the timing chain are arranged inside the chain cover 19.

Next, an oil supply device 200 will be explained in reference to FIGS. 6 to 8. FIG. 6 shows a hydraulic circuit of the oil supply device 200. FIG. 7 is a schematic perspective view of oil supply passages of the oil supply device 200. FIG. 8 is a perspective view showing the engine 100 from which the oil pan 3 is removed, when viewed from below.

The oil supply device 200 is a device configured to supply the oil to respective portions of the engine 100. The oil supply device 200 includes: the cylinder block 2; the oil pan 3; an oil pump 81 configured to suck up the oil from the oil pan 3 and eject the oil; an oil filter 82 configured to filtrate the oil ejected from the oil pump 81; and an oil cooler 83 configured to adjust a temperature of the oil ejected from the oil pump 81. An oil supply passage 7 through which the oil flows is formed at the cylinder block 2 and the oil pan 3. The oil sucked up from the oil pan 3 by the oil pump 81 is filtrated by the oil filter 82 and flows through the oil supply passage 7 to be supplied to the respective portions of the engine 100. The oil cooler 83 is one example of a heat exchanger.

The oil supply passage 7 includes: an upstream oil supply passage 71 mainly formed at the oil pan 3; a downstream oil supply passage 72 mainly formed at the cylinder block 2; and a communication passage 73 through which the upstream oil supply passage 71 and the downstream oil supply passage 72 communicate with each other. Although details will be described later, the downstream oil supply passage 72 includes at least a main gallery 74, a first sub gallery 75, and a second sub gallery 76. The communication passage 73 includes: a first communication passage 73*a* connected to the main gallery 74; a second communication passage 73*b* connected to the first sub gallery 75; and a third communication passage 73*c* connected to the second sub gallery 76.

The upstream oil supply passage 71 includes at least: a first oil supply passage 71*a* connecting the oil pump 81 and the oil filter 82; a second oil supply passage 71*b* connecting the oil filter 82 and the oil cooler 83; a third oil supply passage 71*c* branching from the second oil supply passage 71*b* and connected to a first oil control valve 84; a fourth oil supply passage 71*d* connecting the first oil control valve 84 and the oil pump 81; a fifth oil supply passage 71*e* connecting the oil cooler 83 and the first communication passage 73*a*; a sixth oil supply passage 71*f* branching from the fifth oil supply passage 71*e* and connected to a second oil control valve 85; a seventh oil supply passage 71*g* connecting the second oil control valve 85 and the second communication passage 73*b*; and an eighth oil supply passage 71*h* connecting the second oil control valve 85 and the third communication passage 73*c*.

The oil pump 81 is a known variable capacity oil pump and is driven by the crank shaft 26. As shown in FIG. 8, the oil pump 81 is attached to the lower surface of the lower block 22 and accommodated in the oil pan 3. Specifically, the oil pump 81 includes: a drive shaft 81*a* rotated by the crank shaft 26; a rotor 81*b* coupled to the drive shaft 81*a*; a plurality of vanes 81*c* provided so as to be able to reciprocate in a radial direction from the rotor 81*b*; a cam ring 81*d* accommodating the rotor 81*b* and the vanes 81*c* and configured such that an eccentricity of the cam ring 81*d* with respect to a rotational center of the rotor 81*b* is adjusted; a spring 81*e* configured to bias the cam ring 81*d* in such a direction that the eccentricity of the cam ring 81*d* with respect to the rotational center of the rotor 81*b* increases; a ring member 81*f* arranged inside the rotor 81*b*; and a housing 81*g* accommodating the rotor 81*b*, the vanes 81*c*, the cam ring 81*d*, the spring 81*e*, and the ring member 81*f*.

As shown in FIG. 8, the drive shaft 81*a* projects to an outside of the housing 81*g*. A driven sprocket 81*h* is coupled to a portion of the drive shaft 81*a* which portion is exposed from the housing 81*g*. A timing chain C winds around the driven sprocket 81*h*. The timing chain C also winds around the drive sprocket of the crank shaft 26. Thus, the rotor 81*b* is rotated by the crank shaft 26 through the timing chain C.

When the rotor 81*b* rotates, the vanes 81*c* slide on an inner peripheral surface of the cam ring 81*d*. With this, a pump chamber (operating oil chamber) 81*i* is defined by the rotor 81*b*, two adjacent vanes 81*c*, the cam ring 81*d*, and the housing 81*g*.

A suction port 81*j* and a discharge port 81*k* are formed at the housing 81*g*. The oil is sucked into the pump chamber 81*i* through the suction port 81*j* and ejected from the pump chamber 81*i* through the discharge port 81*k*. An oil strainer 811 is connected to the suction port 81*j*. The oil strainer 811 is immersed in the oil stored in the oil pan 3. To be specific, the oil stored in the oil pan 3 is sucked from the oil strainer 811 through the suction port 81*j* into the pump chamber 81*i*. The first oil supply passage 71*a* is connected to the discharge port 81*k*. To be specific, the oil increased in pressure by the oil pump 81 is ejected from the discharge port 81*k* to the first oil supply passage 71*a*.

The cam ring 81*d* is supported by the housing 81*g* so as to swing around a predetermined fulcrum. The spring 81*e* biases the cam ring 81*d* toward one side around the fulcrum. A pressure chamber 81*m* is defined between the cam ring 81*d* and the housing 81*g*. The oil is supplied from outside through the fourth oil supply passage 71*d* to the pressure chamber 81*m*. The pressure of the oil in the pressure chamber 81*m* acts on the cam ring 81*d*. Therefore, the cam ring 81*d* swings in accordance with a balance between the biasing force of the spring 81*e* and the oil pressure of the pressure chamber 81*m*. Thus, the eccentricity of the cam ring 81*d* with respect to the rotational center of the rotor 81*b* is determined. In accordance with the eccentricity of the cam ring 81*d*, the capacity of the oil pump 81 changes, and an oil ejection amount of the oil pump 81 changes.

The oil ejected from the oil pump 81 flows through the first oil supply passage 71*a* into the oil filter 82 and is filtrated by the oil filter 82. The oil filtrated by the oil filter 82 flows through the second oil supply passage 71*b* into the oil cooler 83 and is cooled by the oil cooler 83. A part of the oil filtrated by the oil filter 82 flows through the third oil supply passage 71*c* into the first oil control valve 84.

The first oil control valve 84 is a pump control device (corresponding to a capacity control valve) configured to control the capacity (ejection amount) of the oil pump 81 in accordance with an operation state of the engine. The first oil control valve 84 supplies the oil, supplied from the third oil supply passage 71*c*, through the fourth oil supply passage 71*d* to the pressure chamber 81*m* of the oil pump 81. In accordance with a control signal transmitted from a below-described controller 300, the first oil control valve 84 adjusts the flow rate (oil pressure) of the oil supplied to the oil pump 81. With this, the capacity of the oil pump 81 is adjusted to a value corresponding to the control signal.

The oil cooled by the oil cooler 83 is supplied through the fifth oil supply passage 71*e* and the first communication passage 73*a* to the main gallery 74 and also supplied through the fifth oil supply passage 71*e* and the sixth oil supply passage 71*f* to the second oil control valve 85.

The second oil control valve 85 controls the flow rate of the first sub gallery 75 and the flow rate of the second sub gallery 76. The seventh oil supply passage 71*g* and the eighth oil supply passage 71*h* are connected to the second oil control valve 85. The seventh oil supply passage 71*g* is connected to the first sub gallery 75 through the second communication passage 73*b*, and the eighth oil supply passage 71*h* is connected to the second sub gallery 76 through the third communication passage 73*c*. The second oil control valve 85 controls the flow rate (oil pressure) of the oil flowing from the sixth oil supply passage 71*f* to the seventh oil supply passage 71*g* to control the flow rate (oil pressure) of the oil of the first sub gallery 75. In addition, the second oil control valve 85 controls the flow rate (oil pressure) of the oil flowing from the sixth oil supply passage 71*f* to the eighth oil supply passage 71*h* to control the flow rate (oil pressure) of the oil of the second sub gallery 76. In the present embodiment, the second oil control valve 85 is configured to control the flow rate (oil pressure) of the oil of the first sub gallery 75 and the flow rate (oil pressure) of the oil of the second sub gallery 76 in conjunction with each other. To be specific, the second oil control valve 85 distributes the oil, supplied from the third oil supply passage 71*c*, to the seventh oil supply passage 71*g* and the eighth oil supply passage 71*h*, and therefore, to the first sub gallery 75 and the second sub gallery 76 while adjusting the flow rate (oil pressure) of the oil. The second oil control valve 85 is one example of a flow control valve configured to control the flow rate of the oil supplied to the first sub gallery 75.

The main gallery 74, the first sub gallery 75, and the second sub gallery 76 are formed at the cylinder block 2 so as to extend in the cylinder column direction. As shown in FIGS. 1 and 2, the main gallery 74 is formed at the first side wall 21*a* of the upper block 21 and is arranged so as to be substantially the same in height as a lower end portion of the cylinder bore 23. The first sub gallery 75 and the second sub gallery 76 are formed at the second side wall 21*b* of the upper block 21 and are arranged so as to be substantially the same in height as the lower end portion of the cylinder bore 23. The main gallery 74 is one example of a first oil passage, the first sub gallery 75 is one example of a second oil passage, and the second sub gallery 76 is one example of a third oil passage.

Figure 6:
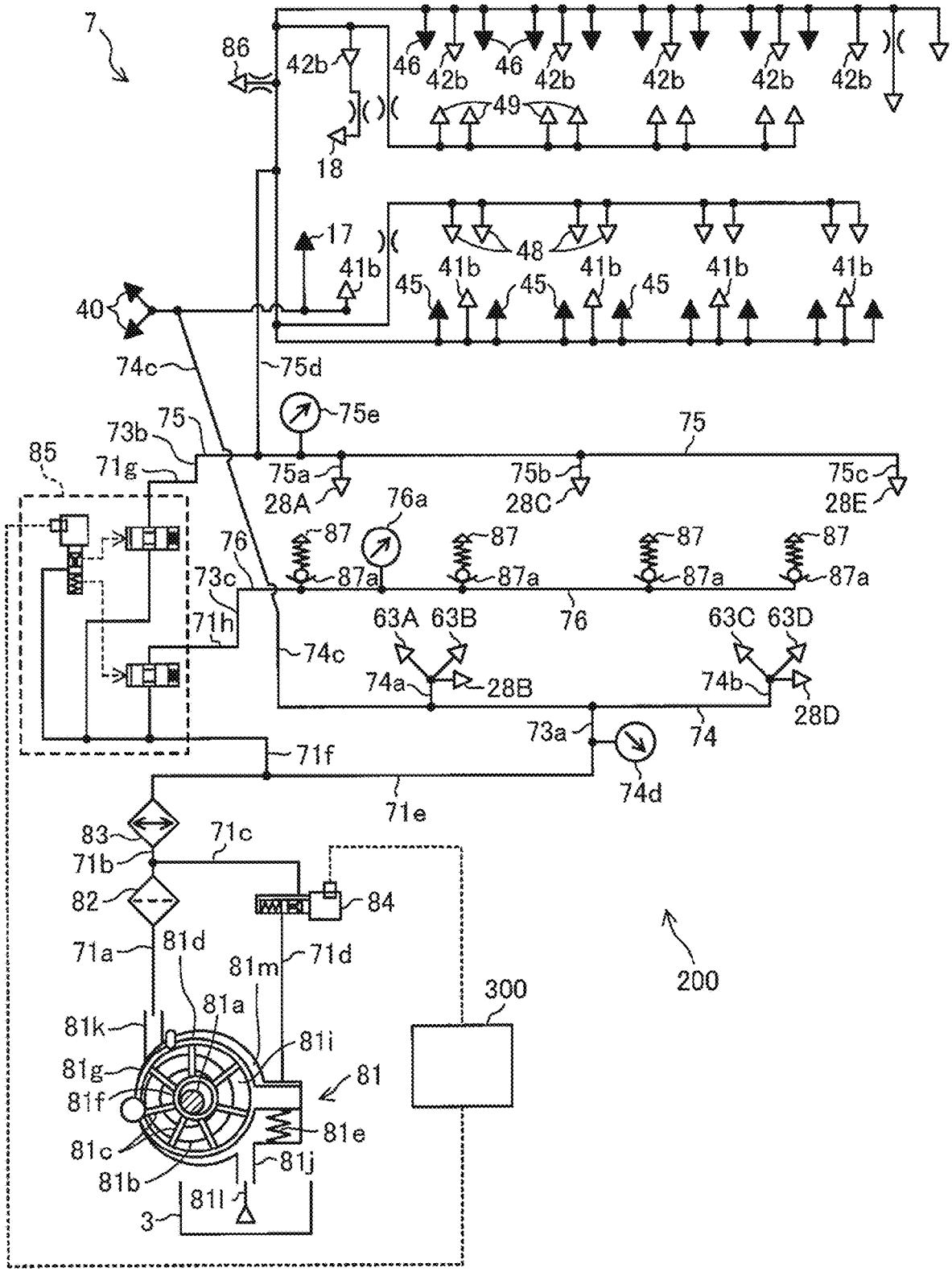
FIG. 6 is a hydraulic circuit diagram of an oil supply device.
Figure 7:
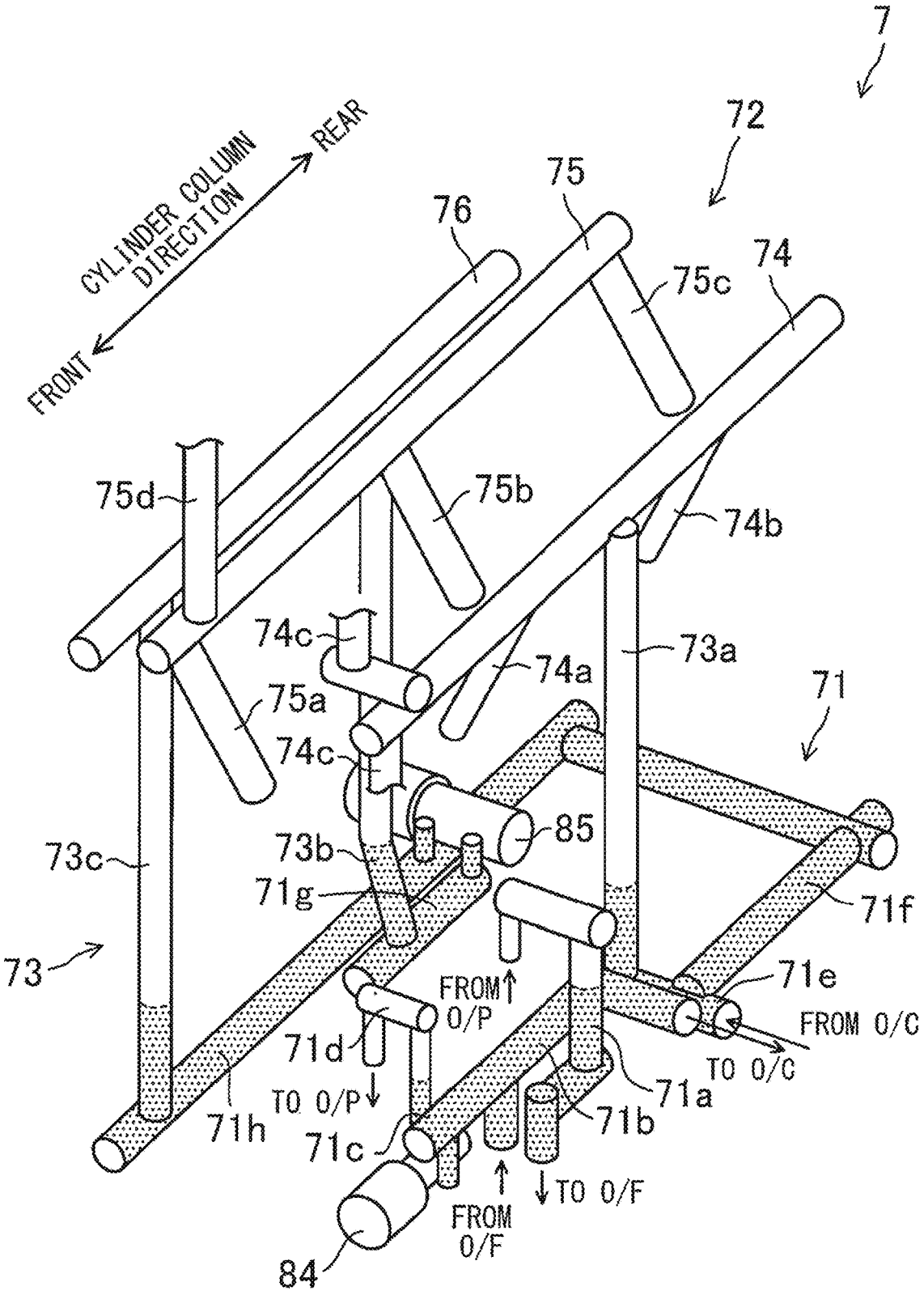
FIG. 7 is a schematic perspective view of oil supply passages of the oil supply device.
Figure 8:
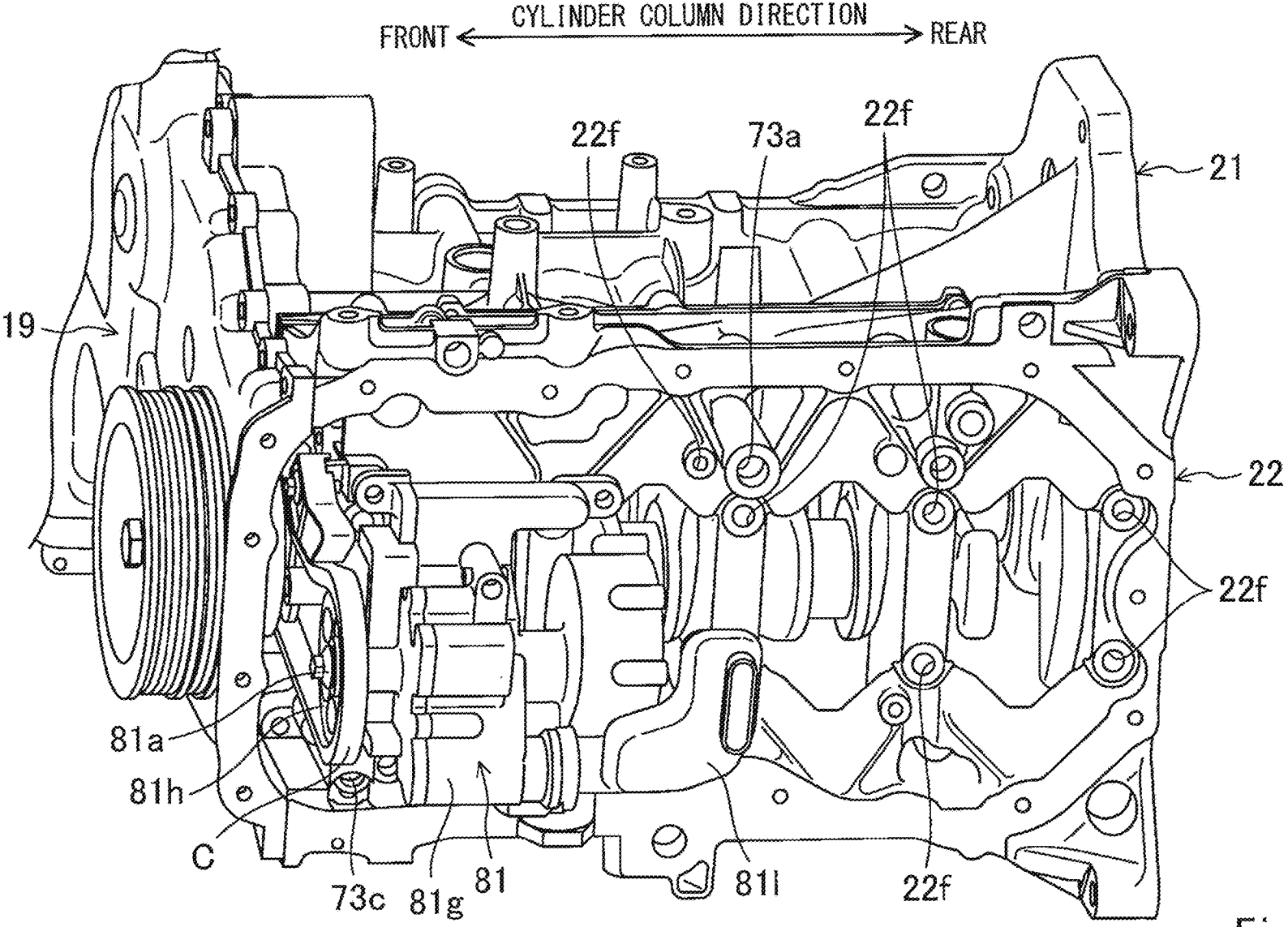
FIG. 8 is a perspective view showing the engine from which an oil pan is removed, when viewed from below.

As shown in FIGS. 6 and 7, a first branch passage 74*a* through which the oil is supplied to the second bearing portion 28B and a second branch passage 74*b* through which the oil is supplied to the fourth bearing portion 28D branch from the main gallery 74. The first branch passage 74*a* extends inside the corresponding vertical wall 21*c* to reach the second bearing portion 28B, and the second branch passage 74*b* extends inside the corresponding vertical wall 21*c* to reach the fourth bearing portion 28D. A downstream end of the first branch passage 74*a* is open on an inner peripheral surface of the semi-circular cutout portion of the corresponding vertical wall 21*c*, and a downstream end of the second branch passage 74*b* is open on an inner peripheral surface of the semi-circular cutout portion of the corresponding vertical wall 21*c*. As described above, the oil supplied to the second bearing portion 28B and the fourth bearing portion 28D is also supplied to the first to fourth crank pins 63A to 63D through the first communication passage 64 and the second communication passage 65. Therefore, the oil pressure of the main gallery 74 is set to be higher than that of the first sub gallery 75 and that of the second sub gallery 76. Further, a third branch passage 74*c* branches from the main gallery 74. The third branch passage 74*c* is further branched to supply the oil to: an oil supply portion 41*b* of a metal bearing arranged at a frontmost cam journal of the intake-side camshaft 41; the intake-side VVT 17; and an oil supply portion 40 of a hydraulic chain tensioner (not shown). A first oil pressure sensor (corresponding to an oil pressure detecting portion) 74*d* is provided at the first communication passage 73*a*. The first oil pressure sensor 74*d* detects the pressure of the oil flowing through the first communication passage 73*a*, and therefore, detects the pressure of the oil flowing through the main gallery 74.

A first branch passage 75*a* through which the oil is supplied to the first bearing portion 28A, a second branch passage 75*b* through which the oil is supplied to the third bearing portion 28C, and a third branch passage 75*c* through which the oil is supplied to the fifth bearing portion 28E branch from the first sub gallery 75. The first branch passage 75*a* extends inside the corresponding vertical wall 21*c* to reach the first bearing portion 28A. The second branch passage 75*b* extends inside the corresponding vertical wall 21*c* to reach the third bearing portion 28C. The third branch passage 75*c* extends inside the corresponding vertical wall 21*c* to reach the fifth bearing portion 28E. A downstream end of the first branch passage 75*a* is open on an inner peripheral surface of the semi-circular cutout portion of the corresponding vertical wall 21*c*. A downstream end of the second branch passage 75*b* is open on an inner peripheral surface of the semi-circular cutout portion of the corresponding vertical wall 21*c*. A downstream end of the third branch passage 75*c* is open on an inner peripheral surface of the semi-circular cutout portion of the corresponding vertical wall 21*c*. Further, a fourth branch passage 75*d* branches from the first sub gallery 75. The fourth branch passage 75*d* is further branched to supply the oil to: the oil supply portions 41*b* and 42*b* of the metal bearings arranged at the cam journals of the camshafts 41 and 42; the HLAs 45 and 46; the oil showers 48 and 49; the exhaust-side VVT 18; and an oil jet 86 of the timing chain C. The oil is supplied to the exhaust-side VVT 18 through the oil supply portion 42*b* of the metal bearing. A second oil pressure sensor 75*e* is provided at the first sub gallery 75 and detects the pressure of the oil flowing through the first sub gallery 75.

Oil jets 87 configured to cool the pistons 24 are connected to the second sub gallery 76. The oil jets 87 are provided for the respective cylinder bores 23. Each of the oil jets 87 includes a check valve 87*a* and a nozzle 87*b* (see FIG. 1) arranged at a part of the second side wall 21*b* of the upper block 21, that is, at a ceiling portion of the crank chamber so as to face the corresponding cylinder bore 23. The nozzle 87*b* is configured to inject the oil toward a rear surface of the piston 24. A third oil pressure sensor 76*a* is provided at the second sub gallery 76 and detects the pressure of the oil flowing through the second sub gallery 76.

After the oil supplied to the respective portions of the engine 100 through the main gallery 74, the first sub gallery 75, and the second sub gallery 76 finishes cooling and lubricating, the oil is dropped into and stored in the oil pan 3 through a drain oil passage (not shown).

The oil supply device 200 configured as above is controlled by the controller 300. The controller 300 includes a processor and a memory, and detection signals from various sensors configured to detect the operation states of the engine 100 are input to the controller 300. For example, detection signals from the first oil pressure sensor 74*d*, the second oil pressure sensor 75*e*, and the third oil pressure sensor 76*a* are input to the controller 300 in addition to detection signals from a crank angle sensor, an air flow sensor, a water temperature sensor, an oil temperature sensor, and cam angle sensors of the camshafts 41 and 42 in the engine 100. The controller 300 determines the operation states of the engine 100 based on the detection results and controls the oil supply device 200 in accordance with the determined operation states. The controller 300 stores a map that defines target oil pressures corresponding to the operation states of the engine 100. The controller 300 compares the determined operation state with the map to determine the target oil pressure. Then, the controller 300 controls the first oil control valve 84 and the second oil control valve 85 such that the oil pressures detected by the first oil pressure sensor 74*d*, the second oil pressure sensor 75*e*, and the third oil pressure sensor 76*a* become the corresponding target oil pressures.

Specifically, the controller 300 controls the ejection amount of the oil pump 81 such that the oil pressure of the main gallery 74 detected by the first oil pressure sensor 74*d* becomes the target oil pressure. At this time, the controller 300 transmits to the first oil control valve 84 the control signal including a duty ratio corresponding to the target oil pressure. The first oil control valve 84 supplies the oil to the pressure chamber 81*m* of the oil pump 81 at the flow rate corresponding to the duty ratio. With this, the ejection amount of the oil pump 81 is adjusted. The controller 300 adjusts the duty ratio of the control signal such that the oil pressure detected by the first oil pressure sensor 74*d* becomes the target oil pressure.

In addition, the controller 300 controls the second oil control valve 85 such that the oil pressure of the first sub gallery 75 detected by the second oil pressure sensor 75*e* and the oil pressure of the second sub gallery 76 detected by the third oil pressure sensor 76*a* become the corresponding target oil pressures. The controller 300 adjusts the duty ratio of the control signal to adjust an opening degree of the second oil control valve 85, thereby adjusting the oil pressure of the first sub gallery 75 and the oil pressure of the second sub gallery 76.

Figure 9:
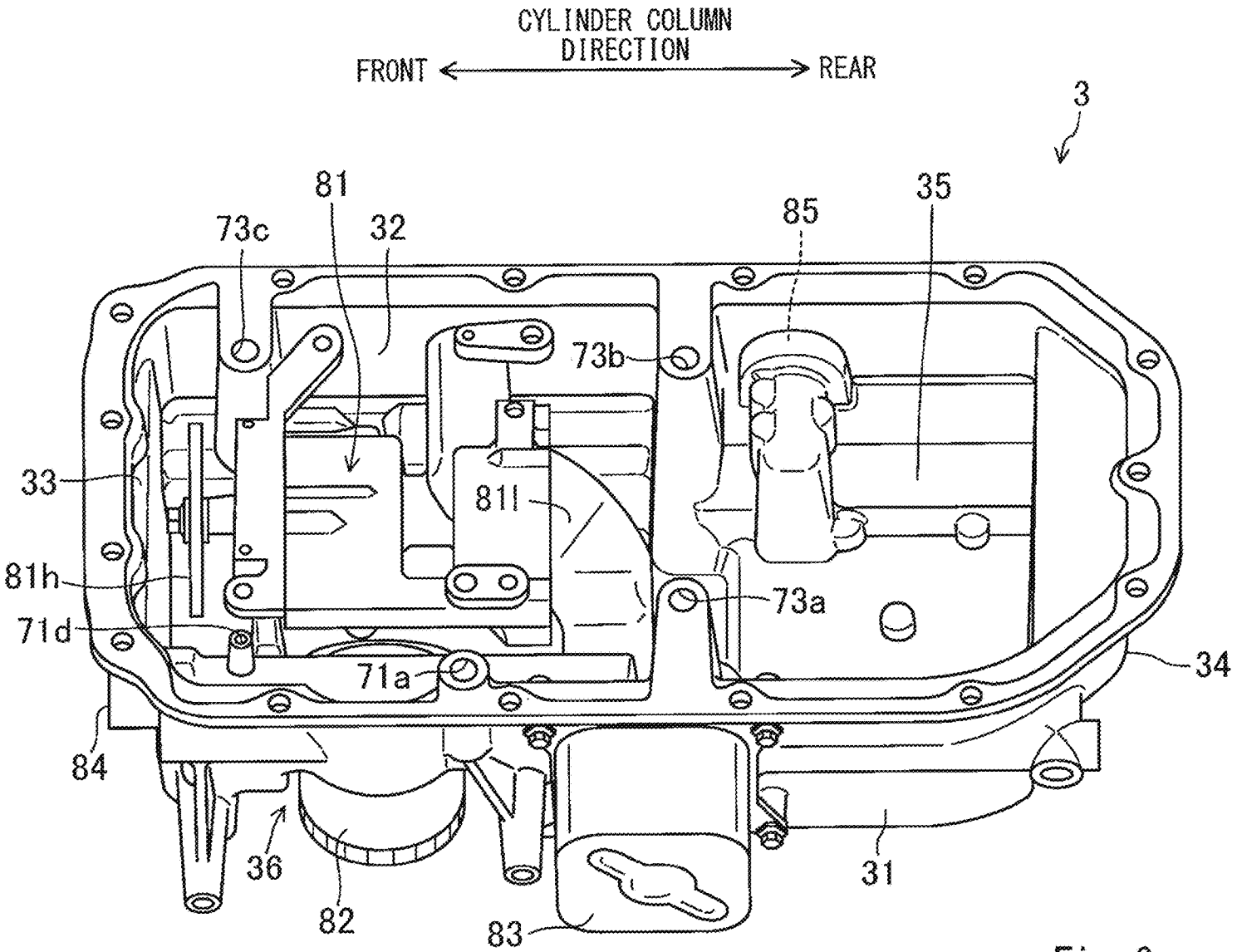
FIG. 9 is a perspective view showing the oil pan when viewed obliquely from above.
Figure 10:
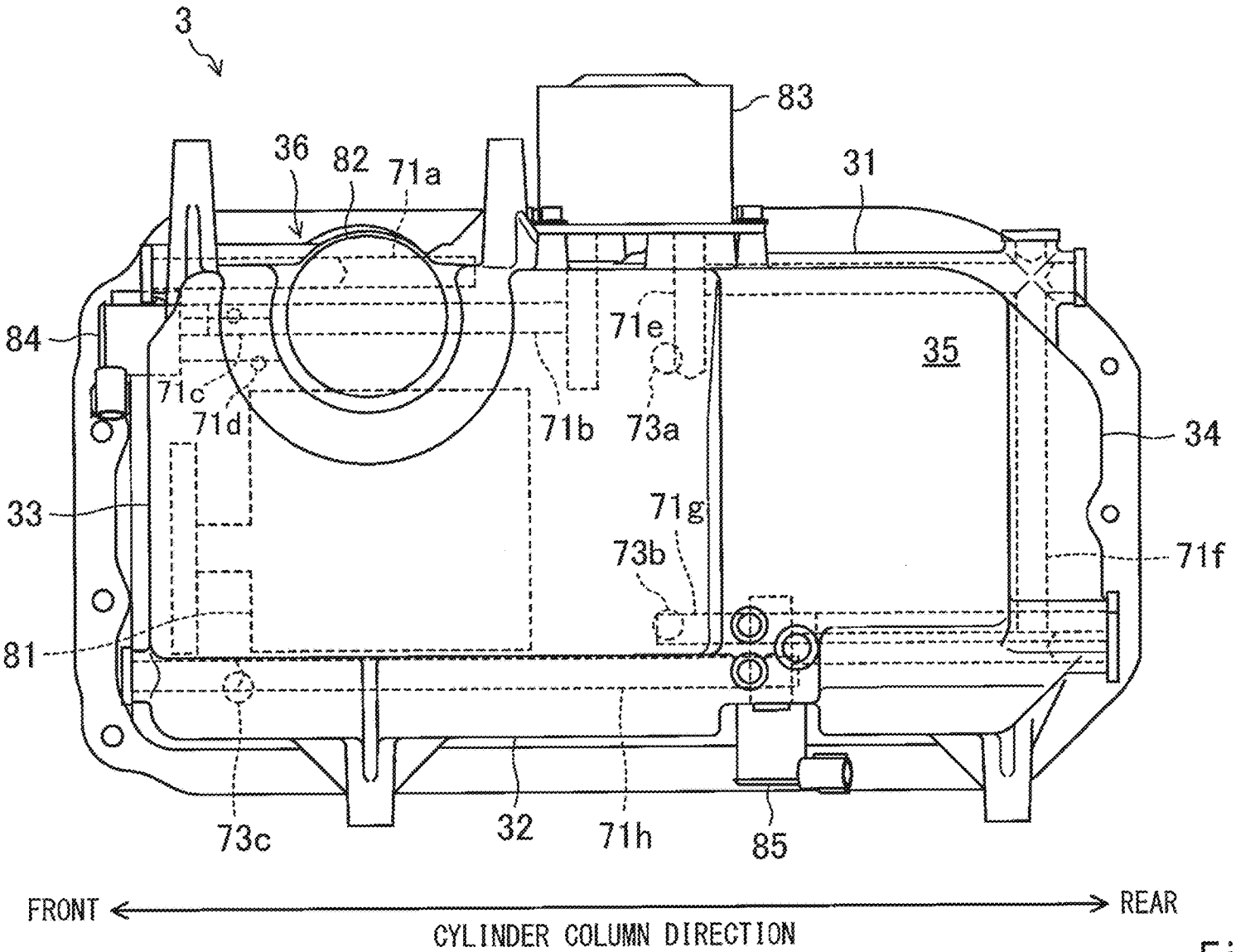
FIG. 10 is a bottom view of the oil pan.

In the oil supply device 200 configured as above, the upstream oil supply passage 71 is formed at the oil pan 3. Hereinafter, detailed configurations of the oil pan 3 and the upstream oil supply passage 71 will be explained in reference to FIGS. 3, 7, 9, and 10. FIG. 9 is a perspective view of the oil pan 3. FIG. 10 is a bottom view of the oil pan 3. It should be noted that in FIG. 7, portions of the oil supply passage 7 which portions are formed at the oil pan 3 are shown by hatching.

As shown in FIG. 9, the oil pan 3 includes an intake-side first side wall 31, an exhaust-side second side wall 32, a front wall 33, a rear wall 34, and a bottom wall 35 and is formed in a box shape that is open upward (i.e., toward the cylinder block 2).

As shown in FIGS. 3, 9, and 10, a concave portion 36 that is concave toward an inner side of the oil pan 3 is formed at a relatively front part of a corner portion formed by the first side wall 31 and the bottom wall 35, and the oil filter 82 is attached to the concave portion 36. The oil cooler 83 is attached to a cylinder column direction substantially middle portion of the first side wall 31. The first oil control valve 84 is attached to a portion of the front wall 33 which portion is located close to the first side wall 31. The second oil control valve 85 is attached to the second side wall 32.

The first oil supply passage 71*a* connecting the oil pump 81 and the oil filter 82, the second oil supply passage 71*b* connecting the oil filter 82 and the oil cooler 83, the third oil supply passage 71*c* branching from the second oil supply passage 71*b* and connected to the first oil control valve 84, the fourth oil supply passage 71*d* connecting the first oil control valve 84 and the oil pump 81, and the fifth oil supply passage 71*e* connecting the oil cooler 83 and the first communication passage 73*a*, which are shown in FIG. 7, are formed at the first side wall 31.

The sixth oil supply passage 71*f* branching from the fifth oil supply passage 71*e* and connected to the second oil control valve 85 is formed from the first side wall 31 to the rear wall 34 and the second side wall 32. To be specific, an upstream portion of the sixth oil supply passage 71*f* is formed at the first side wall 31, an intermediate portion of the sixth oil supply passage 71*f* is formed at the rear wall 34, and a downstream portion of the sixth oil supply passage 71*f* is formed at the second side wall 32.

The seventh oil supply passage 71*g* connecting the second oil control valve 85 and the second communication passage 73*b* and the eighth oil supply passage 71*h* connecting the second oil control valve 85 and the third communication passage 73*c* are formed at the second side wall 32.

The oil filter 82, the oil cooler 83, the first oil control valve 84, and the second oil control valve 85 are attached to the oil pan 3 from outside. By attaching the oil filter 82 to the oil pan 3, the oil filter 82 communicates with the first oil supply passage 71*a* and the second oil supply passage 71*b*. By attaching the oil cooler 83 to the oil pan 3, the oil cooler 83 communicates with the second oil supply passage 71*b* and the fifth oil supply passage 71*e*. By attaching the first oil control valve 84 to the oil pan 3, the first oil control valve 84 communicates with the third oil supply passage 71*c* and the fourth oil supply passage 71*d*. By attaching the second oil control valve 85 to the oil pan 3, the second oil control valve 85 communicates with the sixth oil supply passage 71*f*, the seventh oil supply passage 71*g*, and the eighth oil supply passage 71*h*.

It should be noted that an upstream portion of the first oil supply passage 71*a* and a downstream portion of the fourth oil supply passage 71*d* are formed at the lower block 22. By attaching the oil pump 81 to the lower block 22, the oil pump 81 communicates with the upstream portion of the first oil supply passage 71*a* and the downstream portion of the fourth oil supply passage 71*d*.

Further, each of upstream portions of the first to third communication passages 73*a* to 73*c* is also formed at a wall portion of the oil pan 3. The upstream portion of the first communication passage 73*a* is formed at an inwardly swelling portion of the first side wall 31. The upstream portion of the second communication passage 73*b* and the upstream portion of the third communication passage 73*c* are formed at an inwardly swelling portion of the second side wall 32. The upstream portion of the first communication passage 73*a* and the upstream portion of the second communication passage 73*b* are arranged at a cylinder column direction substantially middle portion of the oil pan 3 and at the rear side of the oil pump 81. The upstream portion of the third communication passage 73*c* is arranged at a cylinder column direction front portion of the oil pan 3. The upstream portion of the first communication passage 73*a*, the upstream portion of the second communication passage 73*b*, and the upstream portion of the third communication passage 73*c* are open upward at the oil pan 3. It should be noted that a downstream portion of the first oil supply passage 71*a* and an upstream portion of the fourth oil supply passage 71*d* are also open upward at the oil pan 3. Each of the first side wall 31, second side wall 32, front wall 33, rear wall 34, and bottom wall 35 of the oil pan 3 is one example of the wall portion of the oil pan.

On the other hand, downstream portions of the first to third communication passages 73*a* to 73*c* are formed at the cylinder block 2. The downstream portions of the first to third communication passages 73*a* to 73*c* penetrate the lower block 22 and are drilled at the upper block 21 to reach the main gallery 74, the first sub gallery 75, and the second sub gallery 76, respectively. As shown in FIG. 2, the downstream portion of the first communication passage 73*a* is formed at the first side wall 21*a* and vertical wall 21*c* of the upper block 21 and the vertical wall 22*c* of the lower block 22. The downstream portion of the second communication passage 73*b* is formed at the second side wall 21*b* and vertical wall 21*c* of the upper block 21 and the vertical wall 22*c* of the lower block 22. Although not shown in FIG. 2, the downstream portion of the third communication passage 73*c* is also formed at the second side wall 21*b* and front wall of the upper block 21 and the front wall of the lower block 22. The downstream portion of the first communication passage 73*a*, the downstream portion of the second communication passage 73*b*, and the downstream portion of the third communication passage 73*c* are open downward at the lower block 22. At the vertical wall 21*c* of the upper block 21 and the vertical wall 22*c* of the lower block 22, the downstream portion of the first communication passage 73*a* is arranged at one side (a side where the first side wall 22*a* is provided) with respect to the cylinder bores 23, the downstream portion of the second communication passage 73*b* is arranged at the other side (a side where the second side wall 22*b* is provided) with respect to the cylinder bores 23, and the downstream portion of the third communication passage 73*c* is arranged at the other side (the side where the second side wall 22*b* is provided) with respect to the cylinder bores 23. Each of the first side wall 21*a*, second side wall 21*b*, vertical wall 21*c*, front wall, and rear wall of the upper block 21 and the first side wall 22*a*, second side wall 22*b*, vertical wall 22*c*, front wall, and rear wall of the lower block 22 is one example of a wall portion of the cylinder block.

It should be noted that the upstream portion of the first oil supply passage 71*a* and the downstream portion of the fourth oil supply passage 71*d* are also open downward at the lower block 22.

By attaching the oil pan 3 to the cylinder block 2, the upstream portions of the first to third communication passages 73*a* to 73*c* communicate with the respective downstream portions of the first to third communication passages 73*a* to 73*c*. It should be noted that by attaching the oil pan 3 to the lower block 22, the upstream portion of the first oil supply passage 71*a* communicates with the downstream portion of the first oil supply passage 71*a*, and the upstream portion of the fourth oil supply passage 71*d* communicates with the downstream portion of the fourth oil supply passage 71*d*.

Next, a method of manufacturing the engine 100 will be explained.

First, the oil pan 3 in which the upstream oil supply passage 71 is formed and the cylinder block 2 in which the downstream oil supply passage 72 is formed are prepared.

Specifically, the cylinder bores 23, the downstream oil supply passage 72, the downstream portion of the first communication passage 73*a*, the downstream portion of the second communication passage 73*b*, and the downstream portion of the third communication passage 73*c* are formed at the cylinder block 2. The downstream oil supply passage 72 includes: the main gallery 74 arranged at one side with respect to the cylinder bores 23 and extending in the cylinder column direction; and the first sub gallery 75 and the second sub gallery 76 arranged at the other side with respect to the cylinder bores 23 and extending in the cylinder column direction. The downstream portion of the first communication passage 73*a* is formed at the first side wall 21*a* of the upper block 21 and the first side wall 22*a* of the lower block 22 and connected to the main gallery 74, the first side walls 21*a* and 22*a* being the side walls located at the same side as the main gallery 74 with respect to the cylinder bores 23. The downstream portion of the second communication passage 73*b* is formed at the second side wall 21*b* of the upper block 21 and the second side wall 22*b* of the lower block 22 and connected to the first sub gallery 75, the second side walls 21*b* and 22*b* being the side walls located at the same side as the first sub gallery 75 with respect to the cylinder bores 23. The downstream portion of the third communication passage 73*c* is formed at the second side wall 21*b* of the upper block 21 and the second side wall 22*b* of the lower block 22 and connected to the second sub gallery 76, the second side walls 21*b* and 22*b* being the side walls located at the same side as the second sub gallery 76 with respect to the cylinder bores 23.

After the upper block 21 and the lower block 22 are separately formed, they are fastened to each other by bolts to form the cylinder block 2. The upper block 21 and the lower block 22 are formed by, for example, casting and machine work.

The upstream oil supply passage 71, the upstream portion of the first communication passage 73*a*, the upstream portion of the second communication passage 73*b*, and the upstream portion of the third communication passage 73*c* are formed at the oil pan 3. The upstream portion of the first communication passage 73*a* is formed at the first side wall 31 that is the side wall located at the same side as the main gallery 74 with respect to the cylinder bores 23. The upstream portion of the second communication passage 73*b* is formed at the second side wall 32 that is the side wall located at the same side as the first sub gallery 75 with respect to the cylinder bores 23. The upstream portion of the third communication passage 73*c* is formed at the second side wall 32 that is the side wall located at the same side as the second sub gallery 76 with respect to the cylinder bores 23. The oil pan 3 is formed by, for example, casting and machine work.

The oil pan 3 is attached to the cylinder block 2, specifically to the lower block 22. A joining portion of the first side wall 31 of the oil pan 3 and a joining portion of the second side wall 32 of the oil pan 3 are coupled by bolts to a joining portion of the first side wall 22*a* of the lower block 22 and a joining portion of the second side wall 22*b* of the lower block 22, respectively. At this time, the upstream portion and downstream portion of the first communication passage 73*a* communicate with each other, the upstream portion and downstream portion of the second communication passage 73*b* communicate with each other, and the upstream portion and downstream portion of the third communication passage 73*c* communicate with each other.

According to this manufacturing method, the positions of the first communication passage 73*a*, the second communication passage 73*b*, and the third communication passage 73*c*, formed at the cylinder block 2 and the oil pan 3, with respect to the cylinder bores 23 are set to be common among engines which are the same or different in the number of cylinder bores 23 as or from one another and are different in displacement from one another. For example, there exist engines which are different in displacement from one another but are the same in basic structures, such as the number of cylinder bores 23 and the positions of center axes of the cylinder bores 23, as one another. The displacements of such engines are made different from one another by changing the diameters of the cylinder bores 23. By making the basic structures of the engines the same as one another as above, designing and manufacturing of the engines having different detailed specifications such as the displacement can be simplified. According to the engine 100 of the present embodiment, the positions of the first communication passage 73*a*, the second communication passage 73*b*, and the third communication passage 73*c* with respect to the cylinder bores 23 are set to be common among the engines which are the same in the number of cylinder bores 23 as one another but are different in displacement from one another. Specifically, as shown FIGS. 11 and 12, the positions of the first communication passage 73*a* and the second communication passage 73*b* between how-manieth cylinder bores 23 in the cylinder column direction are common between the engines which are the same in the number of cylinder bores 23 as each other but are different in displacement from each other. Specifically, in each of these engines, the first communication passage 73*a* and the second communication passage 73*b* are arranged between the second cylinder bore 23B and the third cylinder bore 23C in the cylinder column direction.

Further, distances A1, A2, and A3 from a straight line X coupling the center axes of the cylinder bores 23 to the first communication passage 73*a*, the second communication passage 73*b*, and the third communication passage 73*c* and distances B1, B2, B3 in the cylinder column direction from the center axis of the specific cylinder bore 23 (for example, the first cylinder bore 23A) to the first communication passage 73*a*, the second communication passage 73*b*, and the third communication passage 73*c* are set to be common between the engines which are the same in the number of cylinder bores 23 as each other but are different in displacement from each other.

With this, common architecture of the engine 100 can be realized, and designing and manufacturing of the engines having different detailed specifications such as the displacement can be simplified. To be specific, in each of the engines which are different in displacement from one another, setting (design) of the upstream oil supply passage of the oil pan and the downstream oil supply passage of the cylinder block can be simplified in a short period of time. In addition, a step of positioning and assembling the oil pan and the cylinder block is made common among the engines, and assembly workability can also be improved.

Figure 11:
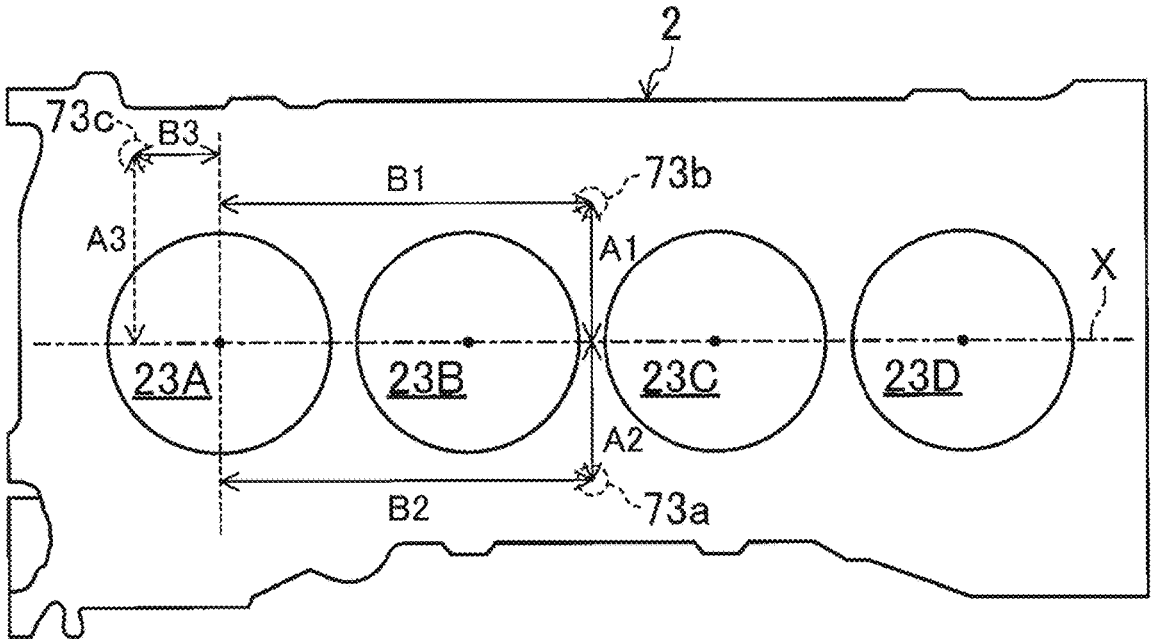
FIG. 11 is a plan view of the cylinder block.
Figure 12:
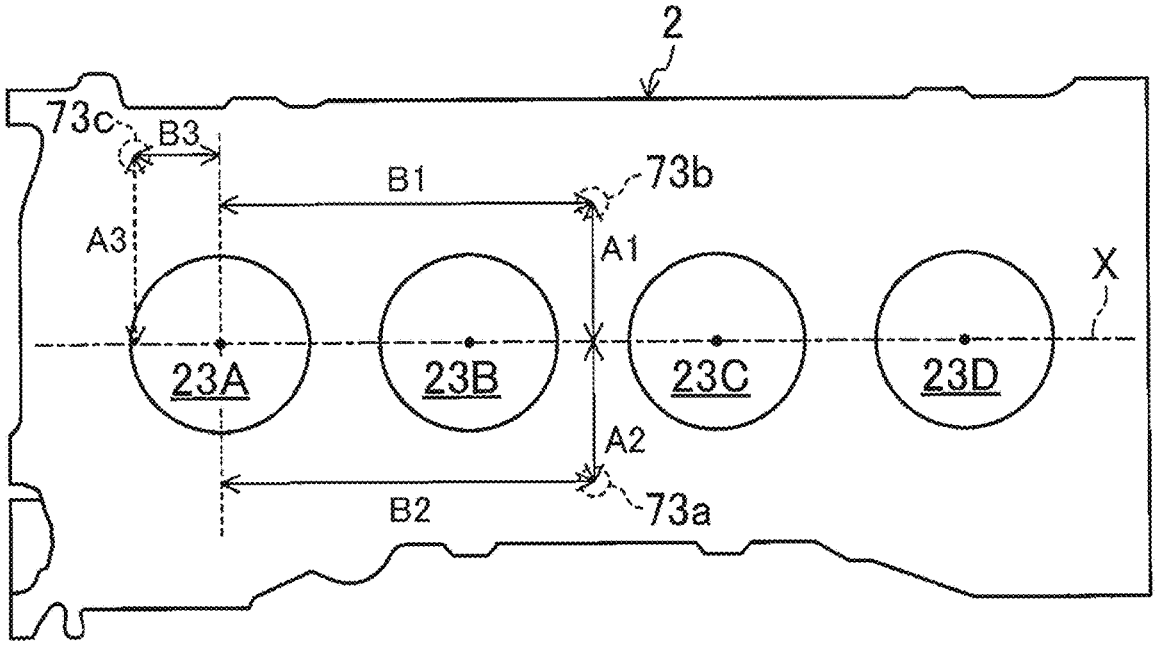
FIG. 12 is a plan view of the cylinder block having a different displacement from the cylinder block of FIG. 11.

It should be noted that the number of cylinder bores does not have to be the same between the engines. For example, the engine including four cylinder bores 23 as shown in FIG. 11 may be replaced with a three-cylinder engine including the cylinder bores 23A, 23B, and 23C. The present embodiment is applicable to plural-cylinder engines. Even when the three-cylinder engine and the four-cylinder engine are compared with each other, these engines are common in that, for example, the first communication passage 73*a* and the second communication passage 73*b* are arranged between the second cylinder bore 23B and the third cylinder bore 23C in the cylinder column direction. Or, the distances B1, B2, and B3 in the cylinder column direction from the center axis of the first cylinder bore 23A as the specific cylinder bores 23 to the first communication passage 73*a*, the second communication passage 73*b*, and the third communication passage 73*c* are set to be common between the three-cylinder engine and the four-cylinder engine.

According to the above configuration, the oil supply passages provided upstream of the first to third communication passages 73*a* to 73*c* connected to the main gallery 74, the first sub gallery 75, and the second sub gallery 76 (hereinafter may be referred to as "the main gallery 74 and the like") are formed at the oil pan 3, so that the oil supply passage 7 can be formed at the oil pan 3 as much as possible, and portions of the oil supply passage 7 which portions are formed at the cylinder block 2 can be simplified. To be specific, since the oil is supplied through the main gallery 74, the first sub gallery 75, and the second sub gallery 76 to respective portions of the cylinder head 1 and the cylinder block 2 which portions require oil supply, the main gallery 74 and the like need to be formed at the cylinder block 2. Then, portions of the oil supply passage 7 which portions are provided upstream of the main gallery 74 and formed at the cylinder block 2 are only the first to third communication passages 73*a* to 73*c*, and portions of the oil supply passage 7 which portions are provided upstream of the first to third communication passages 73*a* to 73*c* are basically formed at the oil pan 3 (It should be noted that a part of the first oil supply passage 71*a* connecting the oil pump 81 and the oil filter 82 and a part of the fourth oil supply passage 71*d* connecting the first oil control valve 84 and the oil pump 81 are formed at the cylinder block 2 since the oil pump 81 is attached to the cylinder block 2.). With this, by mainly changing the configuration of the oil pan 3, it is possible to deal with a case where specifications of a lubrication system need to be changed due to changes in specifications, such as a car segment on which the engine 100 is mounted, the displacement of the engine 100, and presence or absence of an electric system. If the configurations of portions which need to be lubricated or cooled are changed, the changes in the configurations of the main gallery 74 and the like of the oil supply passage 7 and the configurations of portions provided downstream of the main gallery 74 and the like are unavoidable. However, the changes in the configuration of the cylinder block 2 due to the changes in the lubrication system can be reduced as much as possible.

Further, since the oil supply passage 7 is formed at the oil pan 3 as much as possible, and portions of the oil supply passage 7 which portions are formed at the cylinder block 2 are simplified, the positions of the main gallery 74 and the like and the positions of the first to third communication passages 73*a* to 73*c* can be made common among the engines 100 which are different in specifications from one another. As a result, the common architecture of the engine 100 can be realized. For example, if the displacement of the engine 100 changes, the oil storage amount of the oil pan 3 changes, so that the shape of the oil pan 3 may change. At this time, by not changing the positions of the first to third communication passages 73*a* to 73*c* even when the configuration of the upstream oil supply passage 71 is changed, portions of the first to third communication passages 73*a* to 73*c* which portions are formed at the oil pan 3 and portions of the first to third communication passages 73*a* to 73*c* which portions are formed at the cylinder block 2 can be caused to communicate with each other only by attaching the oil pan 3 to the cylinder block 2. Further, when forming the upper block 21 and the lower block 22 by casting, the first to third communication passages 73*a* to 73*c* may also be formed at the time of molding. To be specific, by making the positions of the first to third communication passages 73*a* to 73*c* common, the basic structure of the lower block 22 formed by the casting can be made common among the engines 100 which are different in specifications from one another. Especially, at the lower block 22, the upstream oil supply passage 71 and the downstream oil supply passage 72 are not formed, but only a part of the first to third communication passages 73*a* to 73*c* is formed. Therefore, even when the specifications of the engine 100 are changed, and the configuration of the upstream oil supply passage 71 or the downstream oil supply passage 72 is changed, the configuration of the lower block 22 does not have to be changed.

Figure 13:
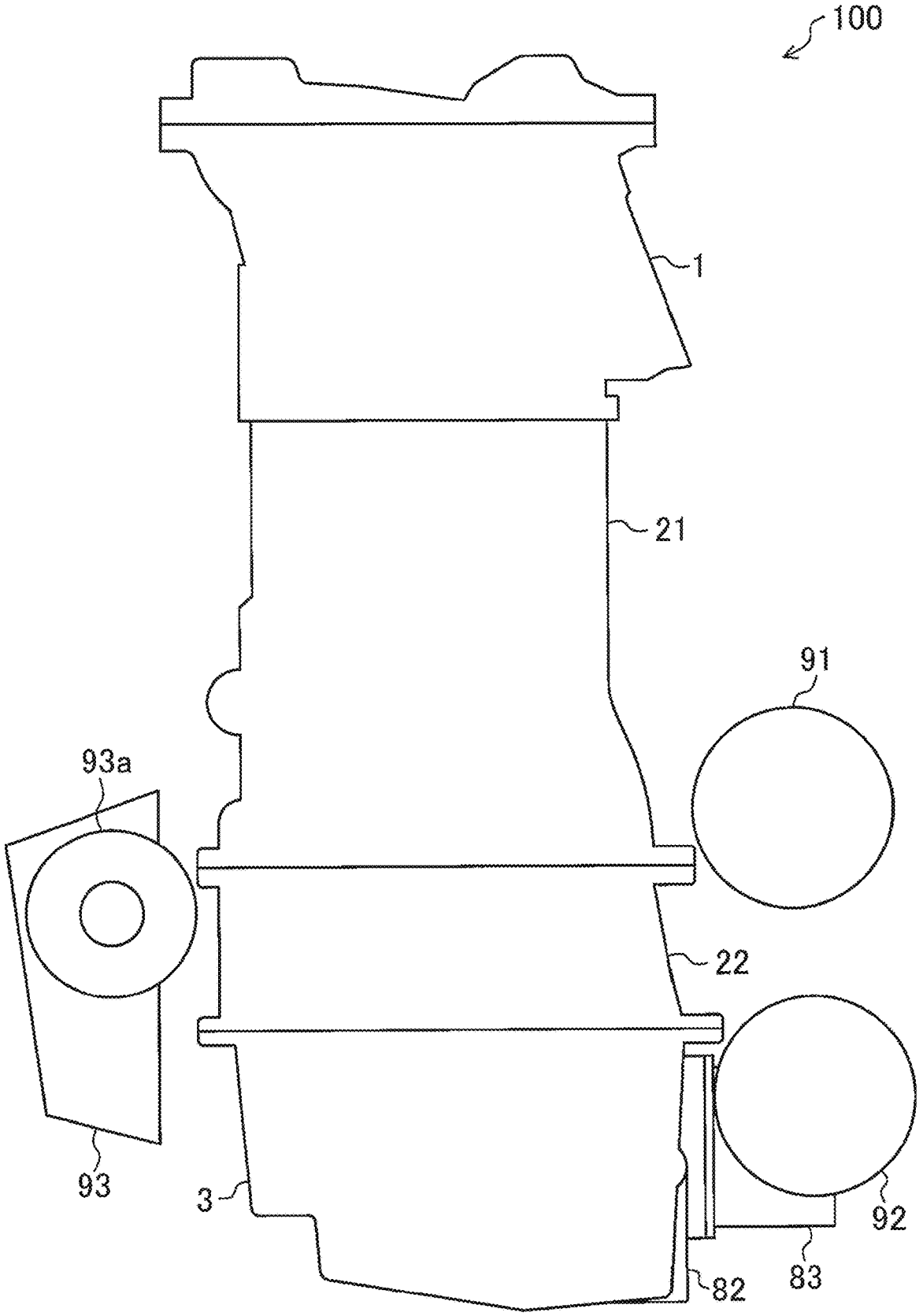
FIG. 13 is a schematic front view of the engine.

Further, since portions of the oil supply passage 7 which portions are provided upstream of the first to third communication passages 73*a* to 73*c* are formed at the oil pan 3, restrictions on the cylinder block 2 due to the oil supply device 200 can be reduced, and the degree of freedom of the layout around the cylinder block 2 can be improved. Specifically, since various auxiliary devices are arranged around the cylinder block 2, a space around the oil pan 3 is wider than a space around the cylinder block 2. Therefore, the oil filter 82, the oil cooler 83, the first oil control valve 84, and the second oil control valve 85, which are included in the portions of the oil supply passage 7 which portions are provided upstream of the first to third communication passages 73*a* to 73*c*, are attached to not the cylinder block 2 but the oil pan 3. With this, the space around the cylinder block 2 is secured. For example, when the specifications of the engine 100 change, areas of the side walls of the engine 100 change, so that an arrangement space for the auxiliary devices changes. When the oil filter 82 and the like are attached to the cylinder block 2, and for example, the areas of the side walls of the engine 100 decrease due to the change in the number of cylinders, it becomes extremely difficult to secure a space for arranging the other auxiliary devices. On the other hand, when the oil filter 82 and the like are attached to the oil pan 3, the space for arranging the other auxiliary devices is easily secured even if the areas of the side walls of the engine 100 decrease. For example, as shown in FIG. 13, an alternator 91 and an air conditioner compressor 92 are arranged at the intake-side side wall of the cylinder block 2. Further, a hybrid vehicle transmission 93 including an electric motor 93*a* is arranged at the exhaust-side side wall of the cylinder block 2.

In addition, the oil filter 82 and the oil cooler 83 which are relatively large in size among the oil filter 82, the oil cooler 83, the first oil control valve 84, and the second oil control valve 85 are arranged at one side wall (in the present embodiment, the first side wall 31) of the oil pan 3. Therefore, a space is secured around the other side wall of the oil pan 3. To be specific, the auxiliary devices can be arranged by utilizing the space at a lateral side of the oil pan 3. For example, as shown in FIG. 13, a space exists at an exhaust-side lateral side of the oil pan 3, and a lower portion of the transmission 93 attached to the exhaust-side side wall of the cylinder block 2 is located at this space.

In the oil supply device 200 configured as above, both the oil filter 82 and the first oil control valve 84 are attached to the oil pan 3. The first oil supply passage 71*a* extending from the oil pump 81 and the second oil supply passage 71*b* extending to the oil cooler 83 are connected to the oil filter 82. The third oil supply passage 71*c* branching from the second oil supply passage 71*b* and the fourth oil supply passage 71*d* extending to the pressure chamber 81*m* of the oil pump 81 are connected to the first oil control valve 84. Since both the oil filter 82 and the first oil control valve 84 are attached to the oil pan 3, the oil filter 82 and the first oil control valve 84 can be arranged close to each other. As a result, at least the third oil supply passage 71*c* can be shortened. The third oil supply passage 71*c* forms a control oil passage together with the fourth oil supply passage 71*d*, the control oil passage branching from an oil supply passage through which the oil ejected from the oil pump 81 flows via the oil filter 82, the control oil passage being connected to the pressure chamber 81*m* of the oil pump 81. To be specific, the control oil passage can be shortened by shortening the third oil supply passage 71*c*. With this, a time until the oil flowing through the oil supply passage reaches the pressure chamber 81*m* becomes short, so that responsiveness of capacity control of the oil pump 81 can be improved.

Further, as shown in FIG. 3, the first oil control valve 84 is arranged lower than a level of the oil stored in the oil pan 3. With this, as with the oil cooler 83, a state where the first oil control valve 84 is filled with the oil is maintained. In a case where the first oil control valve 84 is being filled with the oil when starting the engine 100, the oil having desired oil pressure can be quickly supplied to the pressure chamber 81*m* of the oil pump 81. To be specific, the responsiveness for adjusting the capacity of the oil pump 81 when starting the engine can be improved.

By attaching the oil pump 81 to the cylinder block 2, forming the oil supply passage (the first oil supply passage 71*a* and the second oil supply passage 71*b*) and the control oil passage (the third oil supply passage 71*c* and the fourth oil supply passage 71*d*) at the cylinder block 2 and the oil pan 3, and attaching the oil pan 3 to the cylinder block 2, the portions of the oil supply passage which portions are formed at the cylinder block 2 and the portions of the oil supply passage which portions are formed at the oil pan 3 may communicate with each other, and the portions of the control oil passage which portions are formed at the cylinder block 2 and the portions of the control oil passage which portions are formed at the oil pan 3 may communicate with each other.

According to this configuration, the oil pump 81 driven by a crank shaft through a timing chain or a timing belt is easily attached to the cylinder block 2. Further, by attaching the oil pan 3 to the cylinder block 2, the oil supply passage (the first oil supply passage 71*a* and the second oil supply passage 71*b*) and the control oil passage (the third oil supply passage 71*c* and the fourth oil supply passage 71*d*) can be easily formed.

The oil pump 81 is arranged at one side (in the present embodiment, the front side) of the cylinder block 2 in the cylinder column direction, and the first oil control valve 84 is arranged at one side of the oil pan 3 in the cylinder column direction. To be specific, both the oil pump 81 and the first oil control valve 84 are arranged at one side of the engine 100 in the cylinder column direction.

According to this configuration, the oil pump 81 and the first oil control valve 84 are arranged close to each other. The oil pump 81 and the first oil control valve 84 are connected to each other by the fourth oil supply passage 71*d*. Therefore, by arranging the oil pump 81 and the first oil control valve 84 close to each other, the fourth oil supply passage 71*d* can be shortened. With this, the control oil passage can be shortened, and the responsiveness of the capacity control of the oil pump 81 can be improved.

Further, the oil filter 82 is attached to a portion of the oil pan 3 which portion is located at one side in the cylinder column direction, specifically to a front portion of the bottom wall 35 of the oil pan 3.

According to this configuration, the oil pump 81, the oil filter 82, and the first oil control valve 84 are arranged close to one another. With this, the first oil supply passage 71*a* connecting the oil pump 81 and the oil filter 82 can be shortened, and the third oil supply passage 71*c* branching from the second oil supply passage 71*b* connected to the oil filter 82 and connected to the first oil control valve 84 can be shortened. Thus, the oil passages through which the oil output from the oil pump 81 flows into the pressure chamber 81*m* can be shortened. Therefore, the responsiveness of the capacity control of the oil pump 81 can be improved.

Further, since the oil pump 81 is driven by the crank shaft 26 through the timing chain C, the oil pump 81 is arranged at the front side of the cylinder block 2 in the cylinder column direction. The timing chain C is arranged at the side wall of the cylinder block 2 which wall is located at the front side in the cylinder column direction, and the oil pump 81 is arranged close to the timing chain C in the cylinder column direction. To be specific, the above-described "one side in the cylinder column direction" denotes a side in the cylinder column direction where the timing chain is provided.

According to this configuration, the oil pump 81, the oil filter 82, and the first oil control valve 84 are arranged at the front side in the cylinder column direction. Since the timing chain C is arranged at the front wall of the cylinder block 2, it is difficult to attach the first oil control valve 84 to the front wall of the cylinder block 2. However, since the timing chain C is not arranged at the front wall 33 of the oil pan 3, the first oil control valve 84 can be easily attached to the front wall 33 of the oil pan 3. To be specific, the first oil control valve 84 is attached to the oil pan 3, so that when arranging the oil pump 81 close to the timing chain C, the first oil control valve 84 can be attached to the wall portion located at the side where the timing chain is provided. As a result, the first oil control valve 84 can be arranged close to the oil pump 81.

Further, when the engine 100 is viewed from a width direction (intake/exhaust direction) perpendicular to both the forward/rearward direction and the upward/downward direction, as shown in FIG. 10, the oil filter 82 and the first oil control valve 84 are arranged at one side in the width direction, specifically at the intake-side. As above, the oil filter 82 and the first oil control valve 84 are collectively arranged in not only the cylinder column direction but also the width direction, so that the oil filter 82 and the first oil control valve 84 can be arranged further close to each other.

For example, when forming the oil pan 3 by casting, the upstream oil supply passage 71 may be formed by cast holes. To be specific, a plurality of cast holes are formed so as to be open on a surface of the oil pan 3, and opening portions of the cast hole are closed by plugs. The upstream oil supply passage 71 is configured by combining these cast holes, such as by causing the cast holes to intersect with one another. For example, as shown in FIG. 10, regarding the sixth oil supply passage 71*f*, an upstream oil passage 71*x* formed at the first side wall 31 is formed so as to be open at the rear wall 34, an intermediate oil passage 71*y* formed at the rear wall 34 is formed so as to intersect with the upstream oil passage 71*x* formed at the first side wall 31 and be open at the first side wall 31, and a downstream portion 71*z* formed at the second side wall 32 is formed so as to intersect with the intermediate oil passage 71*y* formed at the rear wall 34 and be open at the rear wall 34. Then, by closing the openings of these portions with the plugs, one sixth oil supply passage 71*f* is formed. When forming the oil pan 3 by the casting, other oil supply passages are similarly formed so as to be open at any side wall, and the openings are closed by plugs. Thus, a predetermined oil supply passage is formed.

By arranging a part of the upstream oil supply passage 71 at a rear portion of the oil pan 3 which portion is relatively simple in configuration, the formation by the cast holes can be easily performed. Further, even when forming the upstream oil supply passage 71 by machine work such as drilling by a drill, it is necessary to: once drill holes that are open on the surface of the oil pan 3; and then close opening portions of the holes by plugs. Even in this case, by arranging a part of the upstream oil supply passage 71 at the rear portion of the oil pan 3 which portion is relatively simple in structure, the formation by the machine work can be easily performed.

Especially, in the oil supply device 200 of the present embodiment, the upstream oil supply passage 71 and the downstream oil supply passage 72 communicate with each other at the intake-side side wall and exhaust-side side wall of the cylinder block 2 and the intake-side side wall and exhaust-side side wall of the oil pan 3. Specifically, the first communication passage 73*a* is formed at the intake-side side walls of the cylinder block 2 and the oil pan 3, and the second communication passage 73*b* and the third communication passage 73*c* are formed at the exhaust-side side walls of the cylinder block 2 and the oil pan 3. Therefore, at the oil pan 3, the upstream oil supply passage 71 needs to extend from the first side wall 31 to the second side wall 32. According to this configuration, as described above, it is especially effective to form a part of the upstream oil supply passage 71 at the rear portion of the oil pan 3 which portion is relatively simple in structure, the part coupling a portion of the upstream oil supply passage 71 which portion is connected to the first communication passage 73*a* and a portion of the upstream oil supply passage 71 which portion is connected to the second communication passage 73*b*.

The cylinder block 2 has the division structure constituted by the upper block 21 and the lower block 22. The lower block 22 is fastened to the upper block 21 by bolts at plural positions. The main gallery 74 and the first sub gallery 75 are formed at the upper block 21. A portion of the first communication passage 73*a* which portion is formed at the cylinder block 2 penetrates the lower block 22 and is formed at the upper block 21 at a position between adjacent bolt fastened portions to reach the main gallery 74, and a portion of the second communication passage 73*b* which portion is formed at the cylinder block 2 penetrates the lower block 22 and is formed at the upper block 21 at a position between adjacent bolt fastened portions to reach the first sub gallery 75.

Specifically, as shown in FIG. 8, the first communication passage 73*a* is arranged between two bolt insertion holes 22*f*. With this, the first communication passage 73*a* is formed at a portion where the seal performance between the upper block 21 and the lower block 22 is high. Although not shown in FIG. 8, the second communication passage 73*b* is also arranged between two bolt insertion holes 22*f* As a result, oil leakage can be suppressed at a coupling portion where a portion of the first communication passage 73*a* which portion is formed at the upper block 21 and a portion of the first communication passage 73*a* which portion is formed at the lower block 22 are coupled to each other and a coupling portion where a portion of the second communication passage 73*b* which portion is formed at the upper block 21 and a portion of the second communication passage 73*b* which portion is formed at the lower block 22 are coupled to each other.

In the oil supply device 200 configured as above, as shown in FIG. 10, the oil cooler 83 configured to adjust the temperature of the oil ejected from the oil pump 81 is arranged at the first side wall 31 of the oil pan 3, and the second oil control valve 85 configured to control the amount of oil supplied through the second communication passage 73*b* to the first sub gallery 75 is arranged at the second side wall 32 of the oil pan 3.

According to this configuration, it is unnecessary to attach the oil cooler 83 and the second oil control valve 85 to the cylinder block 2. Therefore, a space for arranging the other auxiliary devices can be secured around the cylinder block 2. Further, the oil cooler 83 and the second oil control valve 85 are arranged at different side walls of the oil pan 3. With this, the degree of freedom of the arrangement of the oil cooler 83 and the second oil control valve 85 can be made higher than a case where the oil cooler 83 and the second oil control valve 85 are collectively arranged at any one of the side walls of the oil pan 3. Thus, the space around the oil pan 3 can be effectively utilized.

In addition, by attaching the oil cooler 83 and the second oil control valve 85 to the oil pan 3, the auxiliary devices relating to the oil supply device 200 can be collectively arranged at the oil pan 3. With this, the upstream oil supply passage 71 to which the oil cooler 83 and the second oil control valve 85 are connected can be formed mainly at the oil pan 3, and the oil supply passages formed at the cylinder block 2 can be simplified. Further, the auxiliary devices relating to the oil supply device 200 and the upstream oil supply passage 71 to which the auxiliary devices are connected are collectively arranged at the oil pan 3, so that even in a case where specifications of the oil supply device need to be changed due to changes in specifications such as a car segment on which the engine 100 is mounted, the displacement of the engine, and presence or absence of an electric system, it is possible to deal with this case by mainly changing the specifications of the oil pan 3. Thus, the changes in the specifications of the cylinder block 2 can be suppressed as much as possible.

The oil cooler 83 is connected to the second oil supply passage 71*b* and the fifth oil supply passage 71*e* which are formed at the first side wall 31. Further, the sixth oil supply passage 71*f*, the seventh oil supply passage 71*g*, and the eighth oil supply passage 71*h* which are formed at the second side wall 32 are connected to the second oil control valve 85. To form the oil supply passages at the side walls of the oil pan 3 as above, the side walls of the oil pan 3 need to be thick. When an outer shape of the oil pan 3 is not restricted, to be specific, a size of the oil pan 3 is not restricted, the side walls of the oil pan 3 can be made thick while maintaining the capacity of the oil pan 3. However, in many cases, the outer shape of the oil pan 3 is restricted to some extent. In such cases, it is difficult to make the side walls of the oil pan 3 thick while making the outer shape of the oil pan 3 large, and the capacity of the oil pan 3 decreases by increasing the thicknesses of the side walls of the oil pan 3. To be specific, the oil storage amount of the oil pan 3 tends to decrease.

In the present embodiment, as shown in FIG. 3, the oil cooler 83 is arranged lower than the level (shown by a broken line) of the oil stored in the oil pan 3. The level of the oil stored in the oil pan 3 is a level corresponding to an engine oil lower limit amount defined for appropriately using the engine 100. To be specific, when the engine is in a normal use state, the oil cooler 83 is always located lower than the level of the oil stored in the oil pan 3. The oil cooler 83 allows the oil to flow therein to perform heat exchange with the oil. Therefore, the oil cooler 83 can store the oil, the amount of which corresponds to the amount of oil flowing therein. To be specific, by arranging the oil cooler 83 lower than the level of the oil stored in the oil pan 3, a state where the oil cooler 83 is filled with the oil is maintained, to be specific, a state where the oil cooler 83 stores the oil is maintained. With this, at least a part of the oil storage amount of the oil pan 3 which amount is reduced by making the side walls thick can be compensated by the oil cooler 83.

Specifically, the oil cooler 83 is only required to be arranged such that at least a part of oil passages inside the oil cooler 83 is located lower than the level of the oil. With this, a part of the oil passages inside the oil cooler 83 can be utilized to store the oil. Further, it is preferable that the oil cooler 83 be arranged such that both its inlet through which the oil flows into the oil cooler 83 and its outlet through which the oil flows out from the oil cooler 83 are located lower than the level of the oil. With this, a large part of the oil passages inside the oil cooler 83 can be utilized to store the oil. Furthermore, it is preferable that the oil cooler 83 be arranged such that the entire oil cooler 83 is located lower than the level of the oil. With this, most of the oil passages inside the oil cooler 83 can be utilized to store the oil.

As above, the embodiment has been explained as an example of the technology disclosed in the present application. However, the technology in the present disclosure is not limited to this and is also applicable to the embodiment to which modifications, replacements, additions, omissions and the like are suitably made. Further, a new embodiment may be prepared by combining the components explained in the above embodiment. Furthermore, the components shown in the attached drawings and the detailed explanations may include not only components essential to solve the problems but also components for exemplifying the above technology and not essential to solve the problems. Therefore, although these non-essential components are shown in the attached drawings and the detailed explanations, the non-essential components should not be regarded as essential.

INDUSTRIAL APPLICABILITY

As explained above, the technology disclosed herein is useful for oil supply devices of engines.

LIST OF REFERENCE CHARACTERS

100 engine
2 cylinder block
21 upper block
21*a* first side wall
21*b* second side wall
22 lower block
22*a* first side wall
22*b* second side wall
23 cylinder bore
24 piston
28 bearing portion
3 oil pan
31 first side wall
32 second side wall
33 front wall
7 oil supply passage
71 upstream oil supply passage
72 downstream oil supply passage
73*a* first communication passage
73*b* second communication passage
73*c* third communication passage
74 main gallery (first oil passage)
75 first sub gallery (second oil passage)
76 second sub gallery (third oil passage)
81 oil pump
81*m* pressure chamber
82 oil filter
83 oil cooler (heat exchanger)
85 second oil control valve (flow control valve)
87 oil jet
93 transmission
93*a* electric motor
200 oil supply device

The invention claimed is:

1. An oil supply device of an engine,
the oil supply device comprising:
a cylinder block including a plurality of cylinder bores lined up in a predetermined cylinder column direction;
an oil pan attached to the cylinder block;
an oil pump configured to suck up oil from the oil pan and elect the oil; and
an oil filter configured to filtrate the oil elected from the oil pump, wherein:
wall portions of the oil pan are coupled to wall portions of the cylinder block;
the oil filter is attached to the oil pan;
an upstream oil supply passage through which the oil filtrated by the oil filter flows is formed at the oil pan;
a downstream oil supply passage including a first oil passage extending in the cylinder column direction is formed at the cylinder block;
a first communication passage through which the first oil passage and the upstream oil supply passage communicate with each other is formed at the wall portions of the cylinder block and the oil pan;
the downstream oil supply passage further includes a second oil passage formed at the cylinder block and extending in the cylinder column direction;
the first oil passage and the second oil passage are arranged so as to sandwich the cylinder bores;
the first communication passage is formed at the wall portion of the cylinder block and the wall portion of the oil pan, these wall portions being located at the same side as the first oil passage with respect to the cylinder bores;
a second communication passage through which the second oil passage and the upstream oil supply passage communicate with each other is formed at the wall portion of the cylinder block and the wall portion of the oil pan, these wall portions being located at the same side as the second oil passage with respect to the cylinder bores;
a flow control valve configured to control a flow rate of the oil supplied to the second oil passage is connected to the upstream oil supply passage; and
the flow control valve is attached to the oil pan.

2. The oil supply device according to claim 1, wherein:
branch passages through which the oil is supplied to specific bearing portions of a crank shaft are connected to the first oil passage; and
branch passages through which the oil is supplied to bearing portions of the crank shaft other than the specific bearing portions are connected to the second oil passage.

3. The oil supply device according to claim 2, wherein:
the downstream oil supply passage further includes a third oil passage formed at the cylinder block and extending in the cylinder column direction; and
oil jets configured to inject the oil to pistons inserted in the cylinder bores are connected to the third oil passage.

4. The oil supply device according to claim 1, wherein:
the oil pump is arranged in the oil pan so as to be located at one side in the cylinder column direction; and
a part of the upstream oil supply passage which part couples a portion of the upstream oil supply passage which portion is connected to the first communication passage and a portion of the upstream oil supply passage which portion is connected to the second communication passage is formed so as to extend through the wall portion of the oil pan, the wall portion being located at the other side of the oil pump in the cylinder column direction.

5. The oil supply device according to claim 4, wherein:
the cylinder block has a division structure constituted by an upper block and a lower block;
the lower block is fastened to the upper block by bolts at plural positions;
the first oil passage and the second oil passage are formed at the upper block;
a portion of the first communication passage which portion is formed at the cylinder block penetrates the lower block and is formed at the upper block at a position between adjacent bolt fastened portions to reach the first oil passage; and
a portion of the second communication passage which portion is formed at the cylinder block penetrates the lower block and is formed at the upper block at a position between adjacent bolt fastened portions to reach the second oil passage.

6. An oil supply device of an engine, the oil supply device comprising:

a cylinder block including a plurality of cylinder bores lined up in a predetermined cylinder column direction;

an oil pan attached to the cylinder block;

an oil pump configured to suck up oil from the oil pan and eject the oil; and an oil filter configured to filtrate the oil ejected from the oil pump, wherein:

wall portions of the oil pan are coupled to wall portions of the cylinder block;

the oil filter is attached to the oil pan;

an upstream oil supply passage through which the oil filtrated by the oil filter flows is formed at the oil pan;

a downstream oil supply passage including a first oil passage extending in the cylinder column direction is formed at the cylinder block;

a first communication passage through which the first oil passage and the upstream oil supply passage communicate with each other is formed at the wall portions of the cylinder block and the oil pan;

a heat exchanger configured to adjust a temperature of the oil ejected from the oil pump; and a hybrid vehicle transmission including an electric motor, wherein:

the heat exchanger and the oil filter are arranged at the oil pan so as to be located at one side with respect to the cylinder bores; and the transmission is arranged at the oil pan so as to be located at the other side with respect to the cylinder bores.

7. An oil supply device of an engine, the oil supply device comprising:

a cylinder block including a plurality of cylinder bores lined up in a predetermined cylinder column direction;

an oil pan attached to the cylinder block;

an oil pump configured to suck up oil from the oil pan and eject the oil; and an oil filter configured to filtrate the oil ejected from the oil pump, wherein:

wall portions of the oil pan are coupled to wall portions of the cylinder block;

the oil filter is attached to the oil pan;

an upstream oil supply passage through which the oil filtrated by the oil filter flows is formed at the oil pan;

a downstream oil supply passage including a first oil passage extending in the cylinder column direction is formed at the cylinder block;

a first communication passage through which the first oil passage and the upstream oil supply passage communicate with each other is formed at the wall portions of the cylinder block and the oil pan;

the oil pump is a variable capacity oil pump including a pressure chamber, a capacity of the oil pump being adjusted in accordance with pressure of the pressure chamber, the oil supply device further comprising a capacity control valve configured to adjust pressure of the oil supplied to the pressure chamber, wherein:

the capacity control valve is connected in a control oil passage branching from the upstream oil supply passage and connected to the pressure chamber;

the capacity control valve is configured to adjust the pressure of the oil supplied to the pressure chamber through the control oil passage; and the capacity control valve is attached to the oil pan.

8. The oil supply device according to claim 7, wherein the capacity control valve is arranged lower than a level of the oil stored in the oil pan.

9. The oil supply device according to claim 7, wherein:

the oil pump is attached to the cylinder block;

the upstream oil supply passage and the control oil passage are formed at the cylinder block and the oil pan; and by attaching the oil pan to the cylinder block, a portion of the upstream oil supply passage which portion is formed at the cylinder block and a portion of the upstream oil supply passage which portion is formed at the oil pan communicate with each other, and a portion of the control oil passage which portion is formed at the cylinder block and a portion of the control oil passage which portion is formed at the oil pan communicate with each other.

10. The oil supply device according to claim 7, wherein:

the oil pump is arranged at the cylinder block so as to be located at one side in the cylinder column direction; and the capacity control valve is attached to the wall portion of the oil pan, the wall portion being located at the one side in the cylinder column direction.

11. The oil supply device according to claim 10, wherein the oil filter is attached to the oil pan so as to be located at the one side in the cylinder column direction.

12. The oil supply device according to claim 7, further comprising an oil pressure detecting portion configured to detect the pressure of the oil flowing through the oil supply passage, wherein the capacity control valve adjusts the pressure of the oil, supplied to the pressure chamber, in accordance with the pressure detected by the oil pressure detecting portion.

13. The oil supply device according to claim 8, wherein:

the oil pump is attached to the cylinder block;

the upstream oil supply passage and the control oil passage are formed at the cylinder block and the oil pan; and by attaching the oil pan to the cylinder block, a portion of the upstream oil supply passage which portion is formed at the cylinder block and a portion of the upstream oil supply passage which portion is formed at the oil pan communicate with each other, and a portion of the control oil passage which portion is formed at the cylinder block and a portion of the control oil passage which portion is formed at the oil pan communicate with each other.

14. An oil supply passage structure of an engine, the engine including:

a cylinder block including a plurality of cylinder bores lined up in a predetermined cylinder column direction;

an oil pan attached to the cylinder block; and an oil pump configured to suck up oil from the oil pan and eject the oil, wherein:

an upstream oil supply passage through which the oil ejected from the oil pump flows is formed at the oil pan;

a downstream oil supply passage including a first oil passage and a second oil passage is formed at the cylinder block, the first oil passage being arranged at one side with respect to the plurality of cylinder bores and extending in the cylinder column direction, the second oil passage being arranged at the other side with respect to the plurality of cylinder bores and extending in the cylinder column direction;

wall portions of the oil pan are coupled to wall portions of the cylinder block;

a first communication passage through which the upstream oil supply passage and the first oil passage communicate with each other is formed at the wall portion of the cylinder block and the wall portion of the oil pan, these wall portions being arranged at the same side as the first oil passage with respect to the plurality of cylinder bores;

a second communication passage through which the upstream oil supply passage and the second oil passage communicate with each other is formed at the wall portion of the cylinder block and the wall portion of the oil pan, these wall portions being arranged at the same side as the second oil passage with respect to the plurality of cylinder bores; and a position of the first communication passage with respect to the plurality of cylinder bores and a position of the second communication passage with respect to the plurality of cylinder bores are set such that these positions are common among engines which are different in displacement from one another.

* * * * *